US010479636B2

(12) United States Patent
Nakano

(10) Patent No.: US 10,479,636 B2
(45) Date of Patent: Nov. 19, 2019

(54) SHEET PROCESSING APPARATUS AND IMAGE FORMING APPARATUS HAVING THE SAME

(71) Applicant: Takahiro Nakano, Misato (JP)

(72) Inventor: Takahiro Nakano, Misato (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/889,877

(22) Filed: Feb. 6, 2018

(65) Prior Publication Data

US 2018/0251331 A1 Sep. 6, 2018

(30) Foreign Application Priority Data

Mar. 2, 2017 (JP) ..... 2017-038880
Mar. 2, 2017 (JP) ..... 2017-038881
Mar. 2, 2017 (JP) ..... 2017-038882

(51) Int. Cl.

| | |
|---|---|
| ***B65H 31/34*** | (2006.01) |
| ***B65H 43/00*** | (2006.01) |
| ***B65H 29/20*** | (2006.01) |
| ***B65H 29/22*** | (2006.01) |
| ***B65H 31/02*** | (2006.01) |

(Continued)

(52) U.S. Cl.

CPC ..... *B65H 31/34* (2013.01); *B65H 29/20* (2013.01); *B65H 29/22* (2013.01); *B65H 31/02* (2013.01); *B65H 31/3027* (2013.01); *B65H 31/36* (2013.01); *B65H 43/00* (2013.01); *B65H 43/04* (2013.01); *B65H 43/06* (2013.01); *B65H 2301/4212* (2013.01); *B65H 2301/4213* (2013.01); *B65H 2404/1521* (2013.01); *B65H 2405/11151* (2013.01); *B65H 2511/17* (2013.01); *B65H 2511/214* (2013.01);

(Continued)

(58) Field of Classification Search

CPC ..... B65H 29/20; B65H 29/22; B65H 31/34; B65H 43/00; B65H 2513/10; B65H 2511/30

See application file for complete search history.

(56) References Cited

U.S. PATENT DOCUMENTS 6,994,339 B2 * 2/2006 Kato ..... B65H 9/06 270/58.11
7,722,041 B2 * 5/2010 Honda ..... B65H 31/10 270/58.19

(Continued)

FOREIGN PATENT DOCUMENTS

JP 4838687 B2 12/2011

*Primary Examiner* — Patrick Cicchino
(74) *Attorney, Agent, or Firm* — Manabu Kanesaka

(57) ABSTRACT

A sheet processing apparatus includes a conveying roller that conveys a sheet, a processing tray on which the sheet from the conveying roller is loaded, a reference stopper provided at one end of the processing tray, a return paddle having an elastic piece for transferring the sheet from the conveying roller to the reference member, and a roller arm that moves the return paddle in the sheet thickness direction at a predetermined moving rate according to the number of sheets loaded on the processing tray. The moving rate of the roller arm is reduced as the number of sheets loaded on the processing tray is increased. With this configuration, aligning property of even a wavy sheet can be suppressed from being deteriorated at sheet loading.

20 Claims, 24 Drawing Sheets

(51) Int. Cl.

| | |
|---|---|
| ***B65H 31/30*** | (2006.01) |
| ***B65H 31/36*** | (2006.01) |
| ***B65H 43/04*** | (2006.01) |
| ***B65H 43/06*** | (2006.01) |

(52) U.S. Cl.
CPC ..... *B65H 2511/30* (2013.01); *B65H 2513/10* (2013.01); *B65H 2801/27* (2013.01)

(56) References Cited

U.S. PATENT DOCUMENTS

| | | | | |
|---|---|---|---|---|
| 7,841,589 | B2 * | 11/2010 | Kawata | B65H 9/06 270/58.07 |
| 8,109,497 | B2 * | 2/2012 | Okamoto | B65H 37/04 270/20.1 |
| 8,439,342 | B2 * | 5/2013 | Okamoto | B65H 31/3027 270/58.08 |
| 9,004,481 | B2 * | 4/2015 | Mimura | B65H 29/14 270/58.11 |
| 9,387,717 | B2 * | 7/2016 | Iwata | B42C 1/12 |
| 9,567,183 | B2 * | 2/2017 | Komiyama | B42B 5/08 |
| 2015/0165809 | A1 * | 6/2015 | Komiyama | B42B 5/08 412/38 |

* cited by examiner

FIG. 13

| Number of sheet | | Clearance A from sheet discharge roller (L1) | Clearance rate A=1 | Return paddle overlap B (L2) | Overlap rate | Return belt lifting rate (L3) |
|---|---|---|---|---|---|---|
| Area a | 5 | 4 | 1 | 7 | 1 | 1 |
| | 10 | 4 | 1 | 7 | 1 | 1 |
| | 15 | 4 | 1 | 7 | 1 | 1 |
| | 20 | 4 | 1 | 7 | 1 | 1 |
| | 25 | 4 | 1 | 7 | 1 | 1 |
| | 30 | 4 | 1 | 7 | 1 | 1 |
| Area b | 35 | 2.5 | 63% | 8.5 | 121% | 63% |
| | 40 | 2.5 | 63% | 8.5 | 121% | 63% |
| | 45 | 2.5 | 63% | 8.5 | 121% | 63% |
| | 50 | 2.5 | 63% | 8.5 | 121% | 63% |
| | 55 | 2.5 | 63% | 8.5 | 121% | 63% |
| | 60 | 2.5 | 63% | 8.5 | 121% | 63% |
| | 65 | 2.5 | 63% | 8.5 | 121% | 63% |
| | 70 | 2.5 | 63% | 8.5 | 121% | 63% |
| | 75 | 2.5 | 63% | 8.5 | 121% | 63% |

FIG. 20

| Number of sheet | | Clearance A from sheet discharge roller (L1) | Clearance rate (4) =1 (L2) | Return paddle overlap B | Overlap rate (7) =1 | Return belt lifting rate (L3) |
|---|---|---|---|---|---|---|
| Area a | 5 | 4 | 100% | 7 | 100% | 100% |
| | 10 | 3.9 | 98% | 7.1 | 101% | 98% |
| | 15 | 3.8 | 95% | 7.2 | 103% | 95% |
| | 20 | 3.7 | 93% | 7.3 | 104% | 93% |
| | 25 | 3.6 | 90% | 7.4 | 106% | 90% |
| | 30 | 3.5 | 88% | 7.5 | 107% | 88% |
| Area b | 35 | 2.5 | 63% | 8.5 | 121% | 63% |
| | 40 | 2.4 | 60% | 8.7 | 124% | 60% |
| | 45 | 2.3 | 58% | 8.8 | 126% | 58% |
| | 50 | 2.1 | 53% | 8.9 | 127% | 53% |
| | 55 | 2 | 50% | 9 | 129% | 50% |
| | 60 | 1.9 | 48% | 9.1 | 130% | 48% |
| | 65 | 1.8 | 45% | 9.2 | 131% | 45% |
| | 70 | 1.7 | 43% | 9.3 | 133% | 43% |
| | 75 | 1.6 | 40% | 9.4 | 134% | 40% |

SHEET PROCESSING APPARATUS AND IMAGE FORMING APPARATUS HAVING THE SAME

BACKGROUND OF THE INVENTION

Field of the Invention

The present invention relates to a sheet processing apparatus that applies processing to a sheet loaded thereon and a sheet image forming apparatus having the same and, more particularly to a sheet processing apparatus that can reliably convey a sheet to a predetermined reference position when loading the sheet on a processing tray.

Description of the Related Art

Conventionally, some image processing apparatuses such as a copier, a laser-beam printer, a facsimile, and a multi-function machine having these functions are provided with a sheet processing apparatus that conveys an image-formed sheet, loads it on a processing tray, and applies processing such as alignment or binding.

In such an image forming apparatus, a sheet to be subjected to processing needs to be placed at a reference position on the processing tray with high accuracy. To respond to such a requirement, there is known a system in which a sheet discharge roller for discharging a sheet bundle from the processing tray is used to convey an image-formed sheet in the processing tray. Specifically, in this system, every time the sheet is loaded on the processing tray, the sheet discharge roller is rotated to the reference position side to convey and place the sheet to/at the reference position.

However, there is a problem in the sheet conveyance to the reference position in the processing tray by the sheet discharge roller. That is, the first sheet can be conveyed without any problem; however, in the second and subsequent sheets, so-called "offset" occurs to cause image overlap (transfer of an image on the first sheet onto the second sheet). This occurs due to excessively strong nip force of the sheet discharge roller with respect to the sheet.

To cope with this problem, there can be adopted a configuration in which a paddle member having a structure in which elastic pieces are made to radially extend is used for conveyance of the second and subsequent sheets to the reference position.

In recent years, under a circumstance where an increase in processing speed and an increase in volume of sheets to be processed are demanded, the number of sheets that can be stored in the processing tray is increased from 60 sheets to 100 sheets or more. Thus, in a configuration where a paddle rotary shaft for rotating the paddle member is fixed, conveying force of the paddle member for a small number of sheets and conveyance force for a large number of sheets differs from each other. That is, when the number of sheets on the processing tray is small, the conveyance force is insufficient to cause a failure of proper conveyance (sheet does not reach the reference position); on the other hand, when the number of sheets on the processing tray is large, the conveyance force is too strong, so that the sheet is conveyed beyond the reference position, which may cause buckling or folding of the sheet.

In order to prevent the shortage of sheet conveying distance due to insufficient paddle conveying force or buckling or folding of the sheet due to excessive paddle conveying force on the processing tray, Japanese Patent No. 4,838,687 discloses a configuration where the distance between the sheet and paddle member (paddle rotary shaft) is kept constant.

The outline of the invention described in Japanese Patent No. 4,838,687 will be described using FIG. 23A. An image-formed sheet is conveyed along a feed path FP from an image forming apparatus (not illustrated) and is carried out onto a processing tray ST by a carry-out roller FR. At the timing when the rear end of the conveyed sheet passes through the carry-out roller FR, a pull-in paddle (return paddle) MP is rotated in the counterclockwise direction in the drawing. As a result, while being held by a sheet carry-in guide SHG, the sheet is conveyed by rotation of a return belt RB to a tray stopper TS to be aligned in position. In the disclosed apparatus, a turnable sheet guide SAG and a turnable rear end guide KG are provided between the return belt RB and the tray stopper TS for sheet guide.

As illustrated in FIG. 23A, in this apparatus, a return paddle rotary shaft MPJ of a return paddle MP is configured to be moved by 10 mm in the vertical direction. In the illustrated example, 100 sheets are loaded on the processing tray ST, and the paddle MP conveys the sheets to the tray stopper TS while being lifted by an amount according to the number of sheets. The positional relationship between the number of sheets to be loaded on the processing tray ST and the return paddle MP is set to a fixed proportional relation where the return paddle MP is lifted by 1 mm every time the number of sheets is increased by 10.

The above relationship is illustrated in FIG. 24 (upper-left graph). That is, height of the return paddle MP is increased proportionally to an increase in the number of sheets. Thus, every time the number of sheets loaded on the processing tray ST is increased by 10, the height of the return paddle MP is increased stepwise by 1 mm. In other words, the return paddle MP is lifted proportionally at a certain inclination (without a change in a lifting rate). Similarly, the return belt RB, the sheet guide SAG, and the rear end guide KG are each also lifted proportionally at a certain inclination. As a result, the conveying force for the uppermost sheet and a target position of the uppermost sheet are kept constant even when the number of sheets to be loaded on the processing tray ST is increased, thereby reducing occurrence of a conveying failure.

SUMMARY OF THE INVENTION

Recently, various types of sheets are used in such an image forming apparatus as described above. For example, a sheet undergoing significant curling (becoming significantly wavy) due to heat generated at image formation is used with high frequency. This significantly wavy sheet (wavy sheet WVS) is increased in dimension in the thickness direction as compared to a normal sheet. That is, the wavy sheet WVS assumes a "fluffy" state and hardly receives the conveying force of the paddle. The "fluffy" state (a state where the waviness of the sheet is large) becomes prominent as the number of sheets is increased. Thus, as illustrated in FIG. 23B, the sheet may bump the return belt RB or sheet guide SAG provided to the left of the return belt RB and stops at that position or may be turned up, which prevents the sheet from reaching the target position or impair aligning property as a sheet bundle.

In this case, when the paddle (return paddle MP) is lifted at a fixed rate both when the number of sheets is small and when the number of sheets is large as in the invention disclosed in Japanese Patent No. 4,838,687, conveying force with respect to the wavy sheet WVS is reduced, or aligning property in the processing tray is deteriorated due to low rigidity. This may occur through such image forming processing that largely changes the property of the sheet, such as heat application or water addition (ink printing) to the sheet.

The present invention has been made in view of the above situations, and the object of the present invention is to suppress aligning property of even the wavy sheet from being deteriorated at sheet loading.

To achieve the above object, the following invention will be disclosed.

A sheet processing apparatus that applies processing to a loaded sheet includes a conveying roller that conveys a sheet, a processing tray on which the sheet from the conveying roller is loaded, a reference member provided at one end of the processing tray, a transfer member that transfers the sheet from the conveying roller to the reference member, and a moving member that moves the transfer member in the sheet thickness direction at a predetermined moving rate according to the number of sheets loaded on the processing tray. The moving rate of the moving member is reduced as the number of sheets loaded on the processing tray is increased.

According to the present invention, aligning property of even a wavy sheet can be suppressed from being deteriorated at sheet loading.

BRIEF DESCRIPTION OF THE DRAWINGS

FIGS. 10A and 10B are views illustrating the position of the return belt, in which FIG. 10A illustrates the lowermost position at which the return belt contacts the processing tray and FIG. 10B illustrates a state where the return belt is separated from the processing tray;

FIG. 13 is a table showing, for each number of sheets, the positional relationship between a sheet loaded on the processing tray and the sheet discharge roller, the return paddle, and the return belt;

FIG. 20 is a table showing, for each number of sheets, the positional relationship between a sheet loaded on the processing tray and the sheet discharge roller, the return paddle, and the return belt in Modification 1;

FIGS. 22A and 22B are views illustrating the position of the return paddle in the apparatus of Modification 2, in which FIG. 22A illustrates a state where the return paddle is at the uppermost position separated from the processing tray, and FIG. 22B illustrates a state where the return paddle is at the lowermost position contacting the processing tray;

FIGS. 23A and 23B are views illustrating a conventional apparatus, in which FIG. 23A is an explanatory view of the conventional apparatus, and FIG. 23B is a view explaining the problem residing in the conventional apparatus.

DESCRIPTION OF THE PREFERRED EMBODIMENTS

[Image Forming Apparatus]

Figure 1:
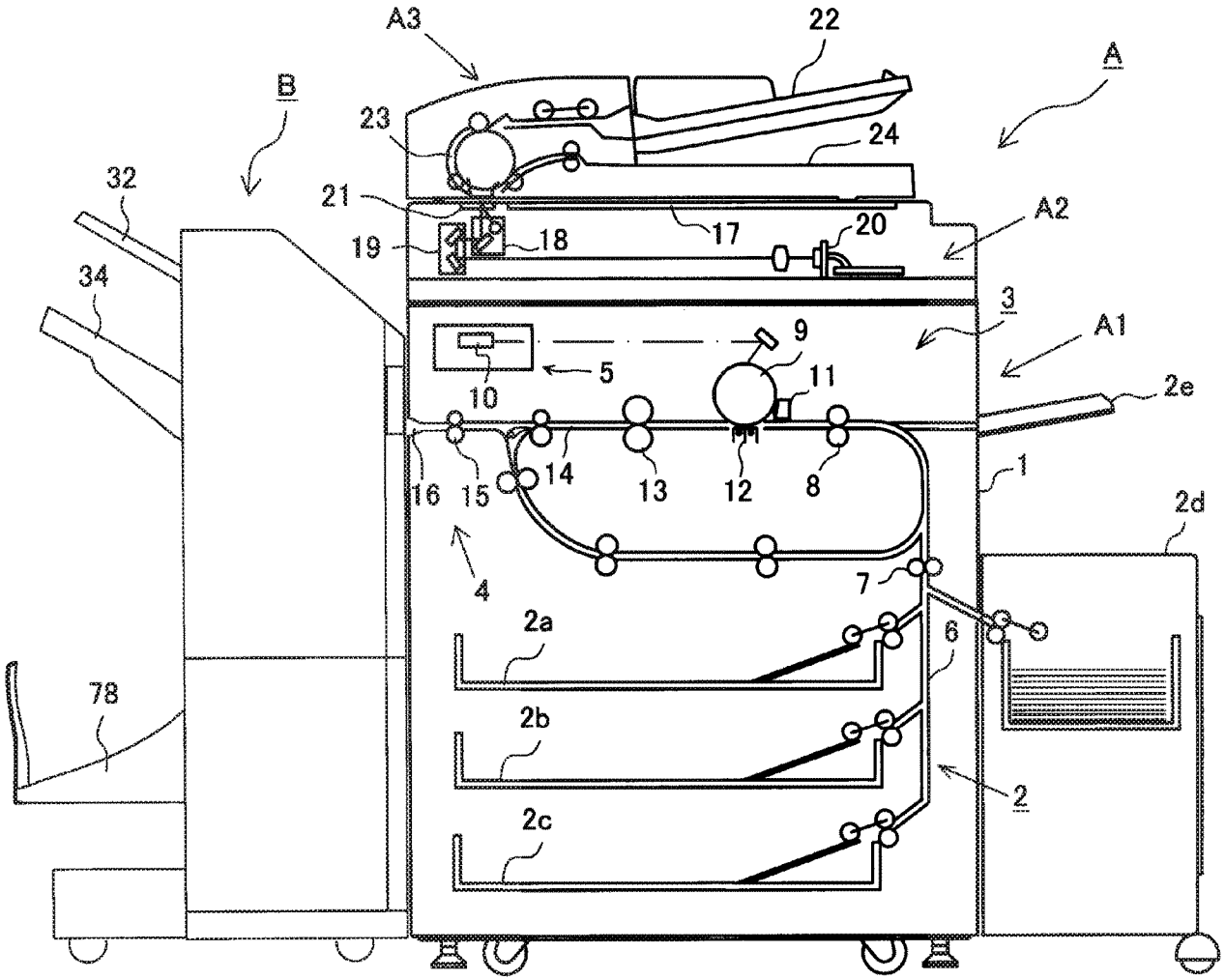
FIG. 1 is an explanatory view illustrating the entire configuration of a system combining an image forming apparatus and a sheet processing apparatus according to the present invention.

An image forming apparatus A illustrated in FIG. 1 will be described. The illustrated image forming apparatus A includes an image forming main body apparatus A1 and a sheet processing apparatus B. The image forming main body apparatus A1 is an electrostatic printing mechanism and includes a reading apparatus A2 and a document feeder A3. An apparatus housing 1 of the image forming main body apparatus A1 incorporates therein a sheet supply section 2, an image forming section 3, a sheet discharge section 4, and a data processing section 5.

The sheet supply section 2 includes cassette mechanisms 2*a* to 2*c* that house sheets of a plurality of different sizes to be image-formed and delivers a sheet of a size, which is designated from an image forming control section 200 through a sheet feed control section 202, to a sheet feed path 6. The plurality of cassettes 2*a* to 2*c* are detachably attached to the apparatus housing 1 and each incorporate therein a separating mechanism that separates sheets stored therein one from another and a sheet feeding mechanism that delivers the sheets. The sheet feed path 6 is provided with a conveying roller 7 that conveys downstream the sheets fed from the plurality of cassettes 2*a* to 2*c* and a resist roller pair 8 that aligns the front ends of the sheets. The resist roller pair 8 is provided at the end portion of the sheet feed path 6.

The sheet feed path 6 is connected with a large capacity cassette 2*d* and a manual feed tray 2*e*. The large capacity cassette 2*d* is an option unit that stores sheets of a size to be consumed massively, and the manual feed tray 2*e* is configured to feed a special sheet that is hard to feed separately, such as a thick sheet, a coated sheet, or a film sheet.

The image forming section 3 is, for example, an electrostatic printing mechanism and includes a photoreceptor 9 (drum or belt) configured to rotate. Further, a light emitter 10 that emits an optical beam to the photoreceptor 9, a developer 11, and a cleaner (not illustrated) are arranged around the photoreceptor 9. The illustrated image forming section 3 is a monochrome printing mechanism. The image forming section 3 optically forms a latent image onto the photoreceptor 9 using the light emitter 10 and attaches toner ink to the latent image using the developer 11.

A sheet is fed from the sheet feed path 6 to the image forming section 3 at the timing of image formation on the photoreceptor 9 and subjected to image transfer by a transfer charger 12, followed by image fixing by a fixing unit (roller) 13 disposed on a sheet discharge path 14. The sheet discharge path 14 is provided with a sheet discharge roller 15, and a main body sheet discharge port 16 is formed at the end of the sheet discharge path 14. The image-formed sheet is conveyed to the sheet processing apparatus B to be described later through the main body sheet discharge port 16.

The reading apparatus A2 includes a platen 17 on which a document is loaded, optical carriages 18 and 19 reciprocated along the platen 17, a light source mounted on the optical carriage 18 and 19, and a reduction optical system (combination of mirrors and lenses) that guides reflective light from the document placed on the platen to a photoelectric converting member 20.

In the reading apparatus A2, a traveling platen 21 (second platen) is further provided to the side of the platen 17. The traveling platen 21 reads an image on a document sheet received from the document feeder A3 using the optical carriages 18, 19, and the photoelectric converting member 20. The photoelectric converting member 20 electrically transfers image data obtained through photoelectric conversion to the image forming section 3.

The document feeder A3 includes a document feed path 23 that guides a document sheet received from a document supply tray 22 to the traveling platen 21 and a document discharge tray 24 that stores a document whose image has been read by the traveling platen 21.

The mechanism of the above image forming main body apparatus A1 is not limited to that described above but may be a printing mechanism such as an offset printing mechanism, an inkjet printing mechanism, and an ink ribbon transfer printing mechanism (thermal transfer ribbon printing, sublimation ribbon printing, or the like).

[Sheet Processing Apparatus]

The sheet processing apparatus B is an apparatus that receives sheets carried out from the main body sheet discharge port 16 of the image forming main body apparatus A1 through an entrance 36 and applies processing to the sheets. The sheet processing apparatus B has the following modes: (1) printout mode; (2) jog sorting mode; (3) binding mode; and (4) bookbinding (saddle-stitching) mode. Details of the above modes will be described later.

The sheet processing apparatus B is not necessarily required to have all the abovementioned modes. The sheet processing apparatus B may be appropriately arranged in accordance with apparatus specifications (design specifications). Even in this case, the sheet processing apparatus B disclosed herein needs to include a binding part B1 (end face binding part) that binds sheets at an end portion thereof from the front and back sides, a saddle-stitching part B2 that saddle-stitches sheets at the middle portion thereof in the sheet conveying direction, and an escape part B3 that does not perform binding but performs sorting and the like. Further, it is required to have a sheet loading part (processing tray 58, etc.) that once conveys sheets to a reference position for alignment before sheet binding.

Figure 2:
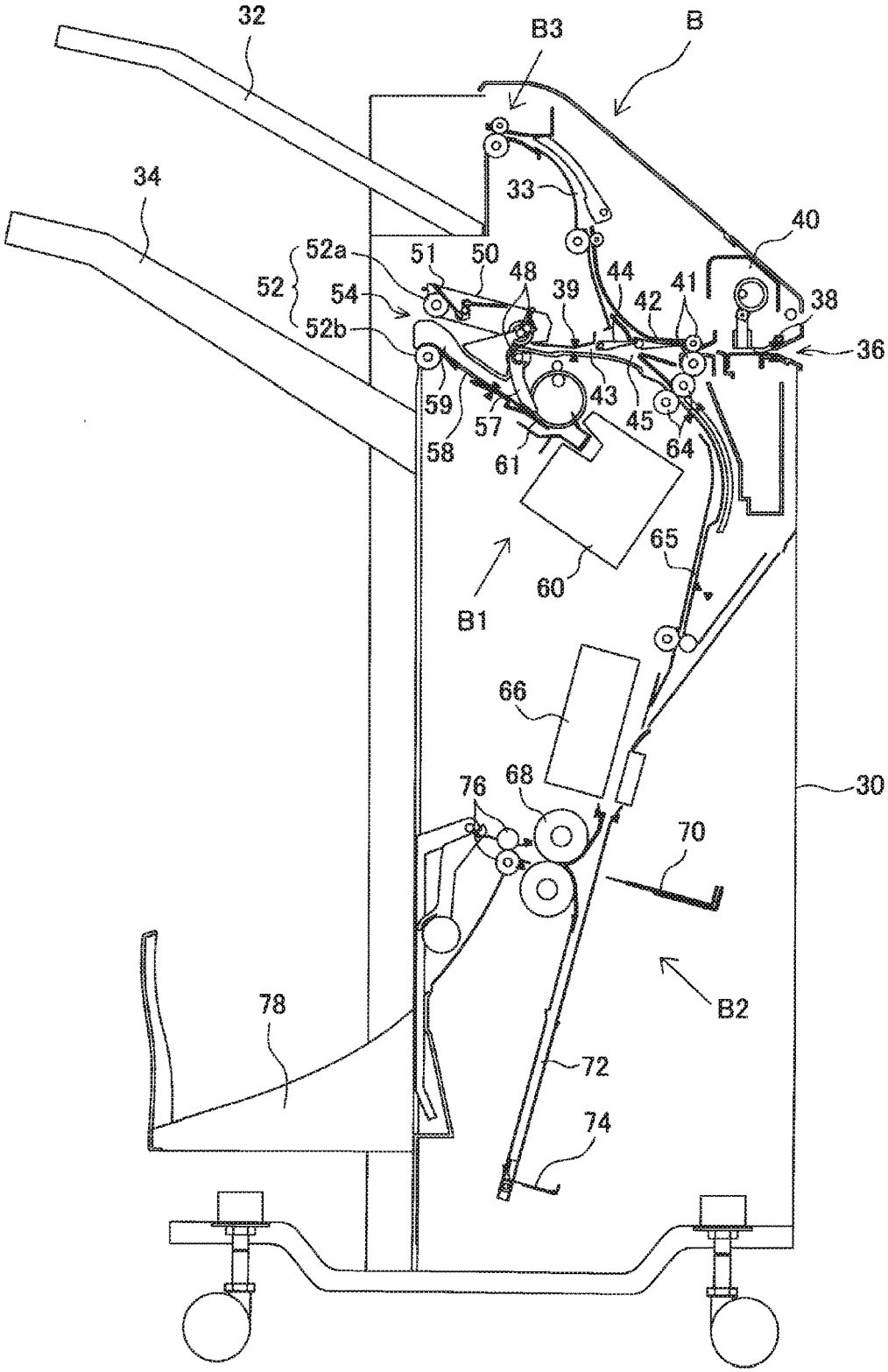
FIG. 2 is an explanatory view illustrating the entire configuration of the sheet processing apparatus according to the present invention.

FIG. 2 illustrates the configuration of the sheet processing apparatus B. The sheet processing apparatus B includes an entrance 36, which is connected to the main body sheet discharge port 16 of the image forming apparatus A. At the entrance 36, an entrance sensor 38 for detecting a sheet fed through the entrance 36 and a punch unit 40 that punches a sheet at the end portion thereof as needed are disposed. Below the punch unit 40, a punch chip box is detachably attached to a processing apparatus frame 30. A carry-in roller 41 and a conveying roller 48 that convey a sheet downstream are provided at the rear of the punch unit 40.

A substantially linearly extending conveying path 43 along which a sheet is conveyed to the processing tray 58 side, an escape path 33 branched upward from the conveying path 43, and a saddle-stitching path 65 that guides a switched-back sheet passing through a merging part 45 of the conveying path 43 are provided at the downstream side of the carry-in roller 41. A sheet conveyed by the carry-in roller 41 is conveyed to the escape path 33 or the saddle-stitching path 65. This switching is made by first and second gates 42 and 44 provided in the middle of the conveying path 43.

[Escape Part]

A sheet conveyed substantially linearly along the conveying path 43 is accumulated in a loading tray 34 as a single sheet or a sheet bundle after once being loaded on the processing tray 58 or directly through a sheet discharge port 54. On the other hand, a sheet conveyed from the conveying path 43 to the escape path 33 provided above the conveying path 43 is accumulated in an escape tray 32. In this case, although not illustrated, a discharge roller at the last stage is configured to be moved at sheet discharge in a direction crossing the extending direction of the conveying path 43 for each specified number of sheets. This enables sorting jog of the escape part B3.

[Saddle-Stitching Part]

The conveying path 43 is provoked with a sheet sensor 39 for detecting the rear end of a conveyed sheet. After detection by the sheet sensor 39, the conveying roller 48 is reversely rotated to convey the sheet to a branch roller 64. The branch roller 64 conveys the sheet along the saddle-stitching path 65, and the conveyed sheet is accumulated in a slightly inclined stacker 72 for saddle-stitching. A bundle of the accumulated sheets is positioned by upward movement of a saddle-stitching sheet stopper 74 such that the middle of the sheet bundle in the conveying direction corresponds to a binding position of a saddle-stitching unit 66.

The sheet bundle thus positioned is bound by the saddle-stitching unit 66 of the saddle-stitching part B2. The bound sheet bundle is then slightly lowered with its binding position aligned to a folding position and folded into two at the folding position by a folding blade 70 and a folding roller 68. The sheet bundle folded into two by the folding roller 68 is discharged to a bundle stacker 78 by a bundle discharge roller 76 and accumulated there as a saddle-stitched binding book. As described above, the escape part B3 and saddle-stitching part B2 are positioned above and below the conveying path 43, respectively.

[End Face Binding Part (Processing Tray and its Peripheral Members)]

Figure 3:
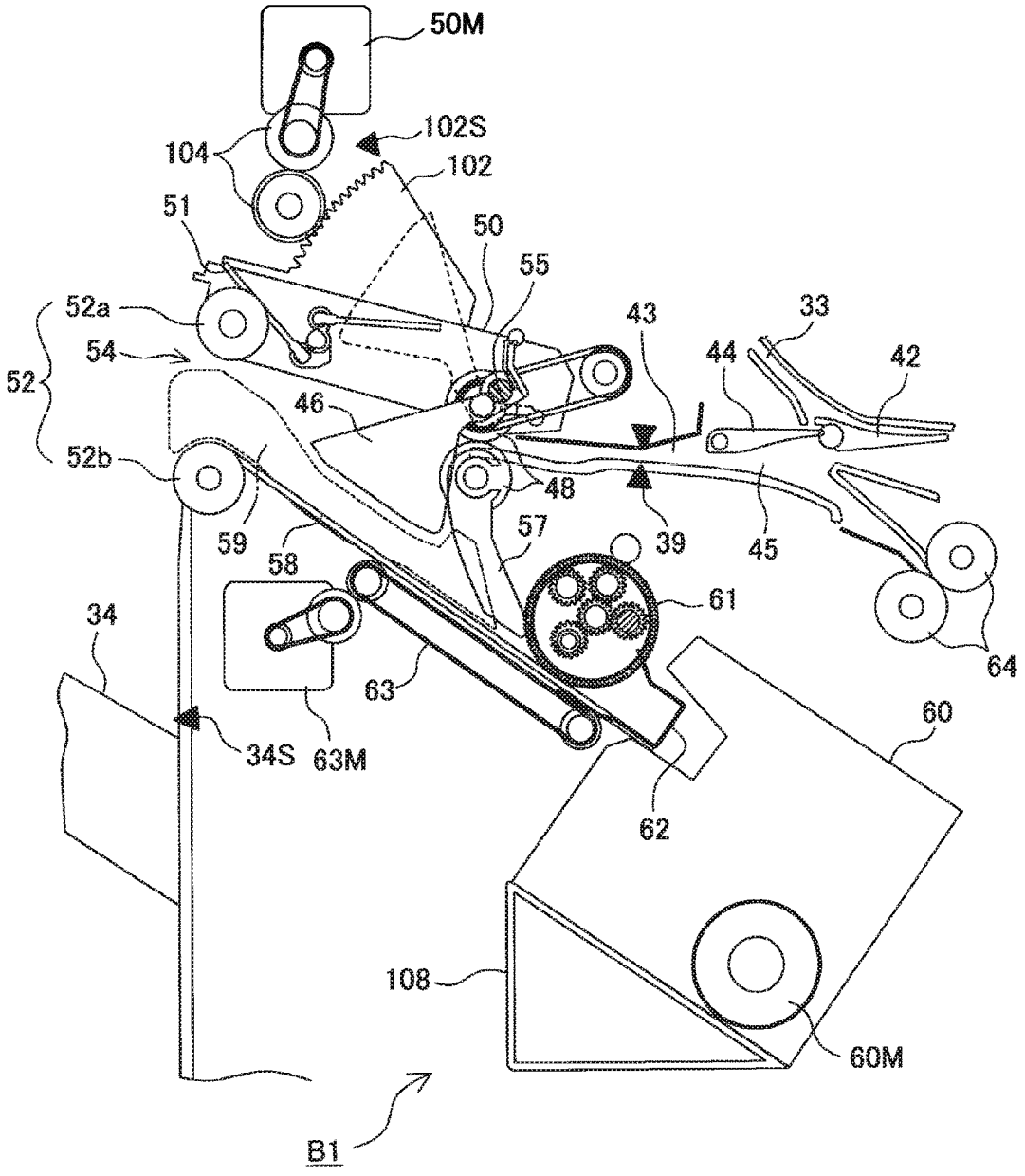
FIG. 3 is an explanatory view illustrating a processing tray and its peripheral members.

The following describes the end face binding part B1 using FIG. 3 and subsequent figures. FIG. 3 illustrates the processing tray 58 constituting the end face binding part B1 and its peripheral members. The processing tray 58 is a tray on which a sheet conveyed from the conveying path 43 to the conveying roller 48 is temporarily loaded for processing. The processing tray 58 is positioned with a level difference from the exit of the conveying roller 48. A drop-in guide 46 is provided at the exit of the conveying roller 48. The drop-in guide 46 drops a sheet to the loading face of the processing tray 58 at the same time when the sheet is carried out from the conveying roller 48. A return paddle 51 having a fin-shaped elastic piece is positioned downstream of the drop-in guide 46 as a transfer member for switch-back transfer of a sheet in the processing tray 58.

A sheet discharge roller 52 is located at a position closer to the loading tray 34 than the return paddle 51 is. The sheet discharge roller 52 is constituted of a turnable upper discharge roller 52*a* and a fixed lower discharge roller 52*b*. The sheet discharge roller 52 performs operation to nip a sheet conveyed from the conveying roller 48 for conveyance to the loading tray 34, to nip a first sheet of sheets to be stored in the processing tray 58 for switch-back conveyance, or to convey a sheet bundle loaded on the processing tray 58 to the loading tray 34. Further, in the sheet discharge roller 52 disclosed herein, the upper discharge roller 52*a* is rotated in the same direction as the return paddle 51 to assist conveyance of the sheet on the processing tray 58 to a reference stopper 62 at the time of the switch-back conveyance. Details of the assistive conveyance will be described later.

As illustrated in FIG. 3, an aligning plate 59 configured to be moved in the sheet width direction crossing the sheet conveying direction every time a sheet is carried out from the conveying roller 48 is provided on the processing tray 58. Although not illustrated, the aligning plate 59 is provided on both sides of a sheet in the sheet width direction so as to sandwich the sheet and is moved in such a direction that the interval between both sides of the aligning plate 59 becomes small for alignment of the sheet in the width direction. The sheet discharge port 54 is formed at one end of the processing tray 58, and the reference stopper 62 as a reference member is provided at the other end of the processing tray 58 obliquely downward of the sheet discharge port 54 so as to receive abutment of a sheet switch-back conveyed by the return paddle 51 and the like.

A carry-in guide 57 for guiding a sheet being switch-back conveyed is provided between the return paddle 51 and the reference stopper 62. The carry-in guide 57 is turnably provided around the lower-side axis of the conveying roller 48 so as to be suspended therefrom by its own weight and guides carry-in of the sheet being switch-back conveyed. Further, there is provided a return belt 61 that further conveys the sheet conveyed by the return paddle 51 toward the reference stopper 62. Further, an end face binding unit 60 is provided at the end portions of the stacked sheets (sheet bundle) stopped by the reference stopper 62.

In the end face binding unit 60, a binding motor 60M is driven to allow a driver to drive a known staple toward an anvil to thereby bind the bundle of sheets whose end portions have been aligned to the reference stopper 62. The end face binding unit 60 is configured to be movable by an end face binding unit moving motor 108M on an end face binding unit stand 108 in the sheet width direction (between the front and the rear of the apparatus) and can thus bind the sheet bundle at the corner portion thereof or a plurality of positions around the center of the end portion. When the end portions of the sheets are not aligned to the reference stopper 62 in such binding processing, a defective booklet may be generated. Thus, alignment at this time is important. A means to bind sheets may include, in addition to the biding using the stapler disclosed herein, binding without a staple, such as binding using a paste or an adhesive, crimping, or folding.

After completion of the binding of the sheet bundle by the end face binding unit 60, a bundle moving belt 63 connected with the reference stopper 62 is driven by a bundle moving belt motor 63M. As a result, the bound sheet bundle is pushed by the reference stopper 62 to be moved to the middle of the processing tray 58. Thereafter, the upper discharge roller 52*a* is lowered during the pushing, and the bound sheet bundle is nipped by the upper and lower discharge rollers 52*a* and 52*b* and discharged toward the loading tray 34 through the sheet discharge port 54.

The loading tray 34 for accumulating a single sheet or a bound sheet bundle is provided below the sheet discharge port 54. To keep constant the height position of the upper surface of the sheets accumulated on the loading tray 34, a loading tray position sensor 34S that detects the upper surface of the sheet is provided in the loading tray 34. When a certain amount of sheets are accumulated, a loading tray motor 34M is driven to move the loading tray 34 to kept constant the height position of the upper surface of the sheets accumulated on the loading tray 34 from the sheet discharge port 54.

Figure 4:
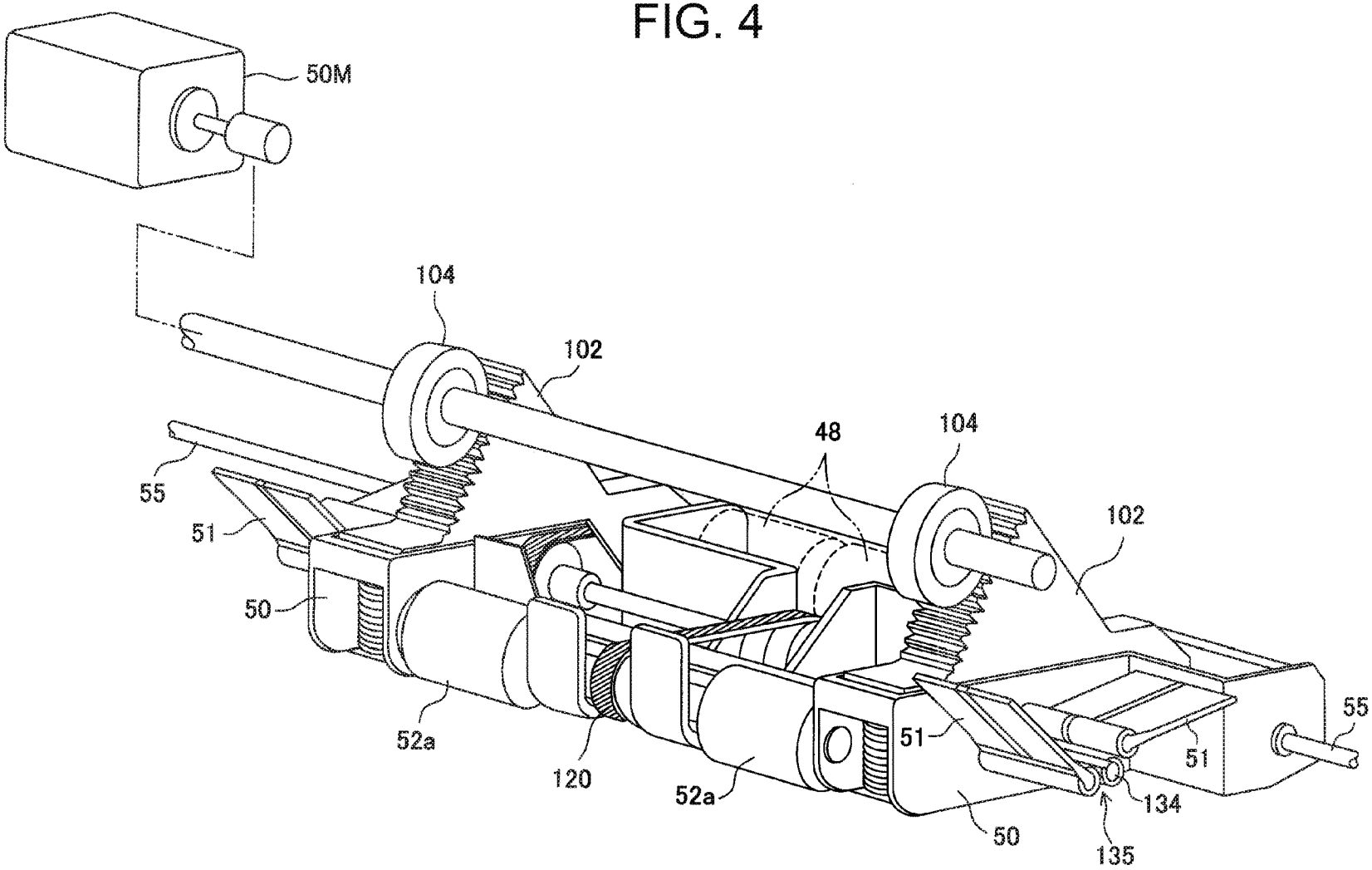
FIG. 4 is a perspective view illustrating a mechanism including a sheet discharge roller and a return paddle which are provided above the processing tray.
Figure 5:
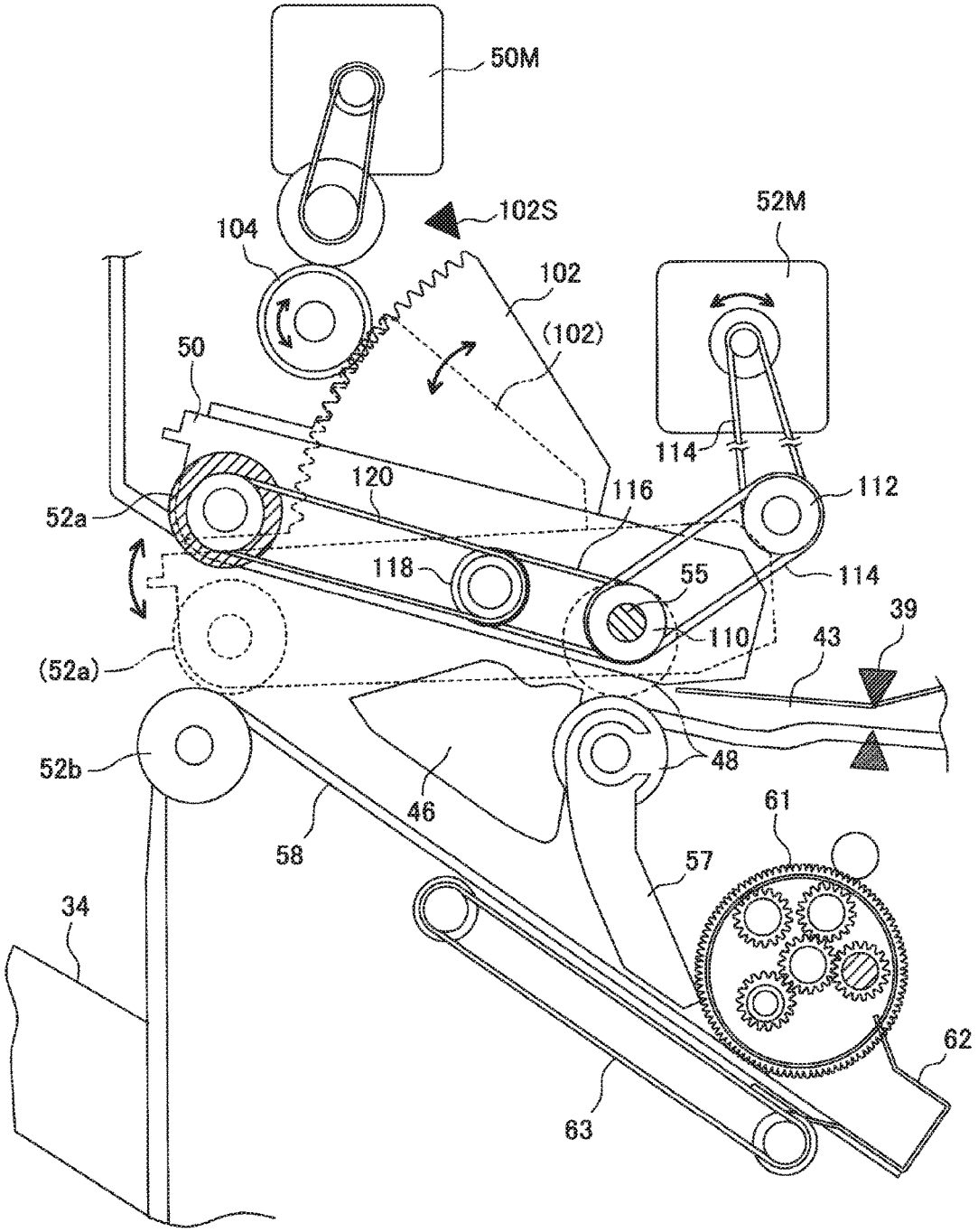
FIG. 5 is an explanatory view of lifting and rotary drive of the sheet discharge roller provided above the processing tray.
Figure 6:
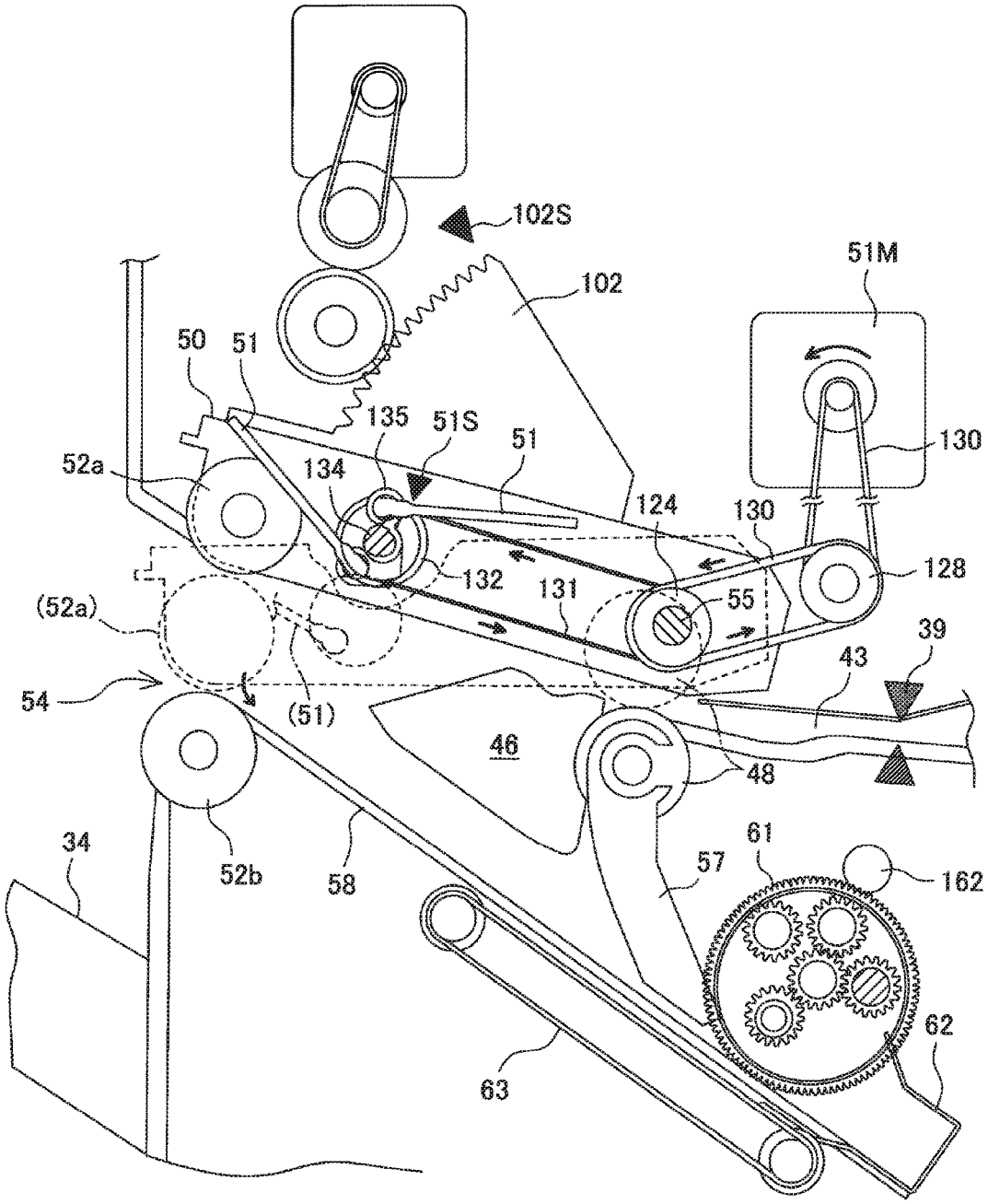
FIG. 6 is an explanatory view of lifting/lowering and rotary drive of the return paddle provided above the processing tray.
Figure 7:
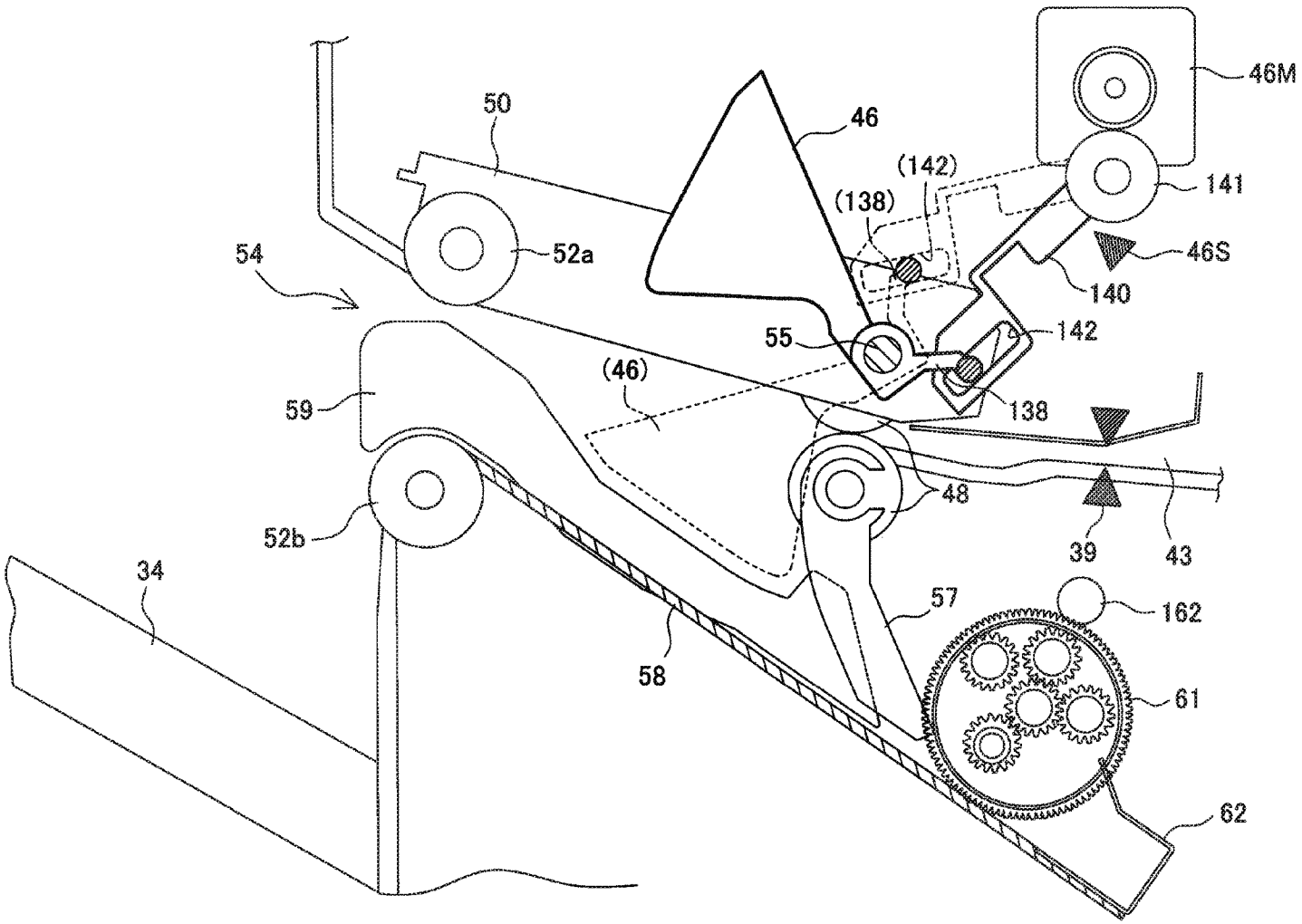
FIG. 7 is an explanatory view of lifting drive of a drop-in guide provided above the processing tray.
Figure 8:
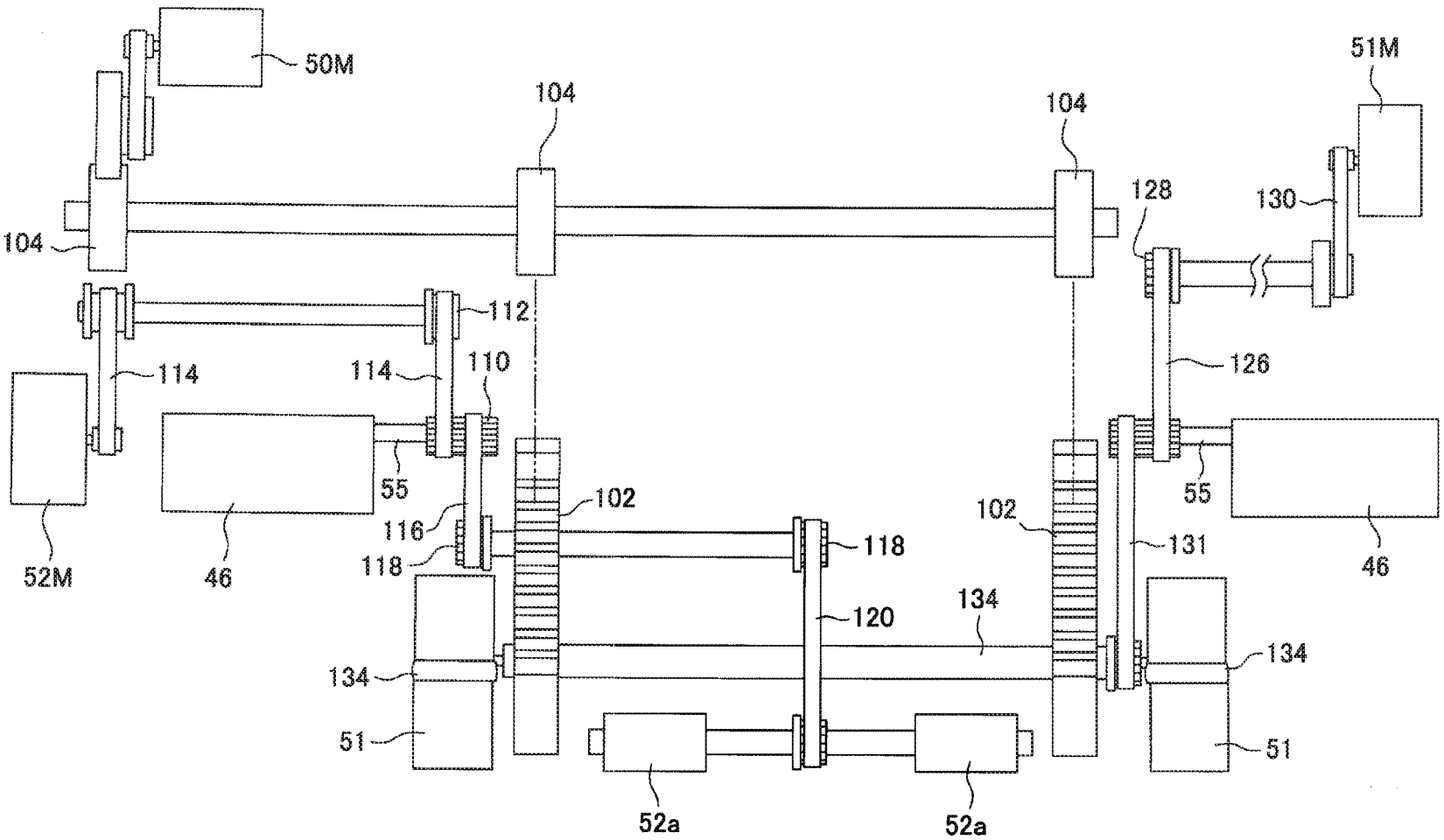
FIG. 8 is a plan view of a drive mechanism of the sheet discharge roller, the return paddle, and the drop-in guide illustrated in FIGS. 3 to 7.

The configurations of the processing tray 58 and its peripheral members that constitute the end face binding part B1 have thus been described. The following describes rotary drive of the above-described upper discharge roller 52*a*, return paddle 51, and return belt 61 and lifting drive thereof in the sheet thickness direction using FIGS. 4 to 8. FIG. 4 is a perspective view including the upper discharge roller 52*a* and return paddle 51 which are positioned above the processing tray 58. FIG. 5 is a view for explaining lifting and rotary drive of the upper discharge roller 52*a*, and FIG. 6 is a view for explaining lifting and rotary drive of the return paddle 51. FIG. 7 is a view for explaining lifting drive of the drop-in guide 46. FIG. 8 is a plan view for explaining a drive system of the upper discharge roller 52*a*, return paddle 51, and drop-in guide 46.

[Drive and Lifting of Sheet Discharge Roller (Upper Discharge Roller)]

The sheet discharge roller 52 will be described mainly using FIG. 5 together with FIGS. 4 and 8. The sheet discharge roller 52 is provided at the sheet discharge port 54 of the processing tray 58 and is constituted of the lower discharge roller 52*b* fixed to the processing tray 58 and the upper discharge roller 52*a* separable and contactable with respect to the lower discharge roller 52*b*. The upper discharge roller 52*a* is supported by a roller arm 50 so as to be rotatable forward and backward. The roller arm 50 is fixed so as to be turned about an arm rotary shaft 55 positioned near the rotary shaft of the upper roller of the conveying roller 48. With this configuration, the upper discharge roller 52*a* is swung with respect to the lower discharge roller 52*b* to nip and discharge a sheet or a sheet bundle to the loading tray 34 together with the lower discharge roller 52*b* or to nip and switch-back convey a single sheet on the processing tray 58 together with the lower discharge roller 52*b*. Further, as described later, the upper discharge roller 52*a* is rotated in the same direction as the return paddle 51 to assist conveyance of the sheet when the return paddle 51 conveys a second sheet to the reference stopper 62 side on the processing tray 58.

As illustrated in detail in FIG. 8, when driving the upper discharge roller 52*a*, drive of a forward/backward rotatable sheet discharge roller motor 52M is transmitted to a transmission gear 110 mounted to the arm rotary shaft 55 through a transmission belt 114 and an intermediate gear 112. Then, the drive from the transmission gear 110 is transmitted to the upper discharge roller 52*a* through an in-arm transmission belt 116 and a roller side transmission belt 120 provided to the roller arm 50. Although not illustrated, when driving the lower discharge roller 52*b*, drive of the sheet discharge roller motor 52M is transmitted to the lower discharge roller 52*b* at the apparatus rear side through a clutch. When there is no need to rotate the lower discharge roller 52*b*, the drive is interrupted by the clutch.

As illustrated in detail in FIG. 4, when turning (lifting/swinging) the upper discharge roller 52*a*, an intermediate gear 104 meshing with a pair of left and right fan-shaped lifting gears 102 integrally provided with the roller arm 50 is driven by a roller arm motor 50M. An arm position sensor 102S is provided around the fan-shaped lifting gear 102 and is configured to detect the height position of the roller arm 50. It is possible to grasp the positional relationship between the upper discharge roller 52*a* and the sheet and the positional relationship between the return paddle 51 and the sheet by detecting the position of the roller arm 50. The roller arm 50 is returned to a position detected by the arm position sensor 102S for each carry-in of the sheet by the conveying roller 48 for confirmation of an initial position (home position). This is conducted for increasing accuracy of the position to which the roller arm 50 is lowered and for preventing interference with carry-in of the sheet.

[Drive and Lifting of Return Paddle]

The return paddle 51 as a transfer member will be described mainly using FIG. 6 together with FIGS. 4 and 8. The return paddle 51 disclosed herein is provided integrally with the roller arm 50 that supports the upper discharge roller 52*a*. When driving the return paddle 51, drive of a return paddle motor 51M provided separately from the sheet discharge roller motor 52M is transmitted to a transmission gear 124 of the arm rotary shaft 55 through a motor belt 130 and an intermediate gear 128. Then drive from the transmission gear 124 is transmitted to a return paddle rotary shaft 134 through an in-arm belt 31 to thereby rotate a return paddle unit 135 having two fin-shaped elastic pieces together with the return paddle rotary shaft 134.

The return paddle 51 is rotated in the counterclockwise direction after the sheet carried out from the conveying roller 48 is dropped by the drop-in guide 46 to switch-back convey the carried-out sheet toward the reference stopper 62. During the switch-back conveyance, the roller arm 50 is lowered to the processing tray 58 side to bring the surface of the conveyed sheet and the leading end of the elastic piece of the return paddle 51 into engagement with each other, thereby producing conveying force.

Further, as illustrated in FIG. 6, the position (direction of the leading end of the elastic piece) of the return paddle 51 is detected by a return paddle sensor 51S. This prevents the two fin-shaped elastic pieces from interfering with sheet conveyance/discharge while a sheet is discharged to the processing tray 58 by the conveying roller 48, when a first sheet is switch-back conveyed by the sheet discharge roller 52, or when a sheet bundle on the processing tray 58 is discharged by the sheet discharge roller 52. Further, as illustrated in FIG. 8, the return paddle 51 is provided on both outer sides (apparatus rear and front sides) of the upper discharge roller 52*a* for rotary drive.

[Lifting of Drop-in Guide]

The drop-in guide 46 will be described mainly using FIG. 7 together with FIGS. 4 and 8. The drop-in guide 46 disclosed herein is provided for quickly guiding the rear of a sheet to the processing tray 58 at the timing of carry-out of the sheet rear end from the conveying roller 48. The drop-in guide 46 is turnably loosely fitted to the arm rotary shaft 55 of the roller arm 50. A guide turning member 138 is provided at the end portion of the drop-in guide 46. The guide turning member 138 is fitted into a guide moving arm slit 142 of a guide moving arm 140 turned by a drop-in guide motor 46M.

Thus, as illustrated in FIG. 7, when the guide moving arm 140 is moved to a position denoted by the dashed line by drive of the drop-in guide motor 46M, the drop-in guide 46 is correspondingly moved in such a direction that a sheet is forcibly dropped to the processing tray 58. As illustrated in FIG. 8, a pair of the drop-in guides 46 are arranged above the processing tray 58 in the sheet width direction so as to be each positioned outside the upper discharge roller 52*a* and return paddle 51 in the sheet width direction. The upper discharge roller 52*a*, the return paddle 51, and the drop-in guide 46 have been described in terms of rotary drive and lifting motion thereof.

[Return Belt Drive and Lifting]

Figure 9:
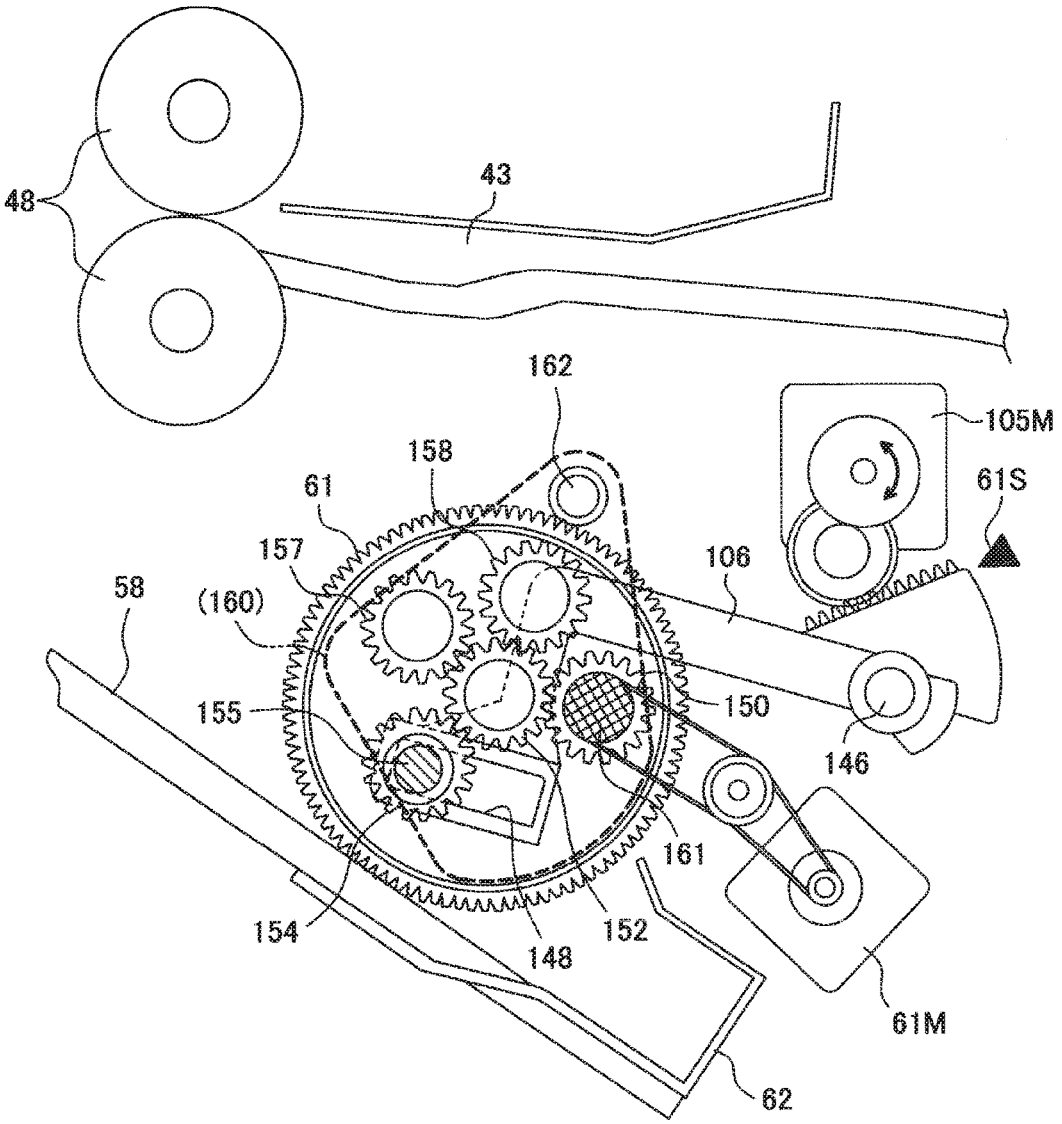
FIG. 9 is an explanatory view of lifting and rotary drive of a return belt positioned at the end portion of the processing tray.

The liftable/lowerable return belt 61 that contacts the upper surface of a sheet at a position close to the reference stopper 62 of the processing tray 58 to convey the sheet to the reference stopper 62 side will be described using FIGS. 9 and 10. FIG. 9 illustrates rotary drive of the return belt 61 and lifting drive thereof on the processing tray 58 in the sheet thickness direction on the processing tray 58. The return belt 61 is provided as a pair spaced apart from each other in the sheet width direction. FIG. 9 is a view as viewed from one side of the return belt 61. The return belt 61 has, inside the belt circumference, an in-belt drive gear 150 serving as a drive base point, an in-belt center gear 152 meshed with the in-belt drive gear 150, and an in-belt lower gear 154 meshed with the in-belt center gear 152 from below. Further, an in-belt upper gear 158 and an in-belt side gear 157 are meshed with the in-belt center gear 152 from above and the side, respectively. Furthermore, a belt pressing roller 162 is provided at a position opposite to the in-belt upper gear 158 across the return belt 61. The shaft of each of the above-described gears is supported from both sides by a belt frame 160 denoted by the dashed line.

When rotating the return belt 61 in the counterclockwise direction (the direction in which a sheet is conveyed to the reference stopper 62) in the drawing, drive of a return belt motor 61M is transmitted to the in-belt drive gear 150 through an appropriate drive belt. The shaft supporting the in-belt drive gear 150 serves as a belt lift-turning shaft 161. Lifting of the return belt 61 is made by engaging a crank-shaped return belt arm 106 with a lower gear arm engagement shaft 155 of the in-belt lower gear 154 and lifting the belt frame 160 about the belt lift-turning shaft 161. The return belt arm 106 is moved by forward/backward rotation of a return belt lifting motor 105M about a return belt arm turning shaft 146. At this time, the height position of the return belt 61 is detected by a return belt position sensor 61S.

Thus, drive (rotation) of the return belt motor 61M is transmitted to the in-belt upper gear 158 through the in-belt drive gear 150 and the in-belt center gear 152 to allow the return belt 61 having the above-described driving configuration to be rotated while being nipped between the in-belt upper gear 158 and belt pressing roller 162 located opposite thereto. The drive of the return belt motor 61M is also transmitted to the in-belt lower gear 154 and in-belt side gear 157 so as to smoothly drive the return belt 61 even when the shape of the return belt 61 itself is deformed due to increase/decrease in the number of sheets loaded on the processing tray 58. A plurality of knurls are formed in the surface of the illustrated return belt 61. Further, although not illustrated, engagement teeth engaged with the above gears are formed in the inner surface of the return belt 61.

Figure 10A:
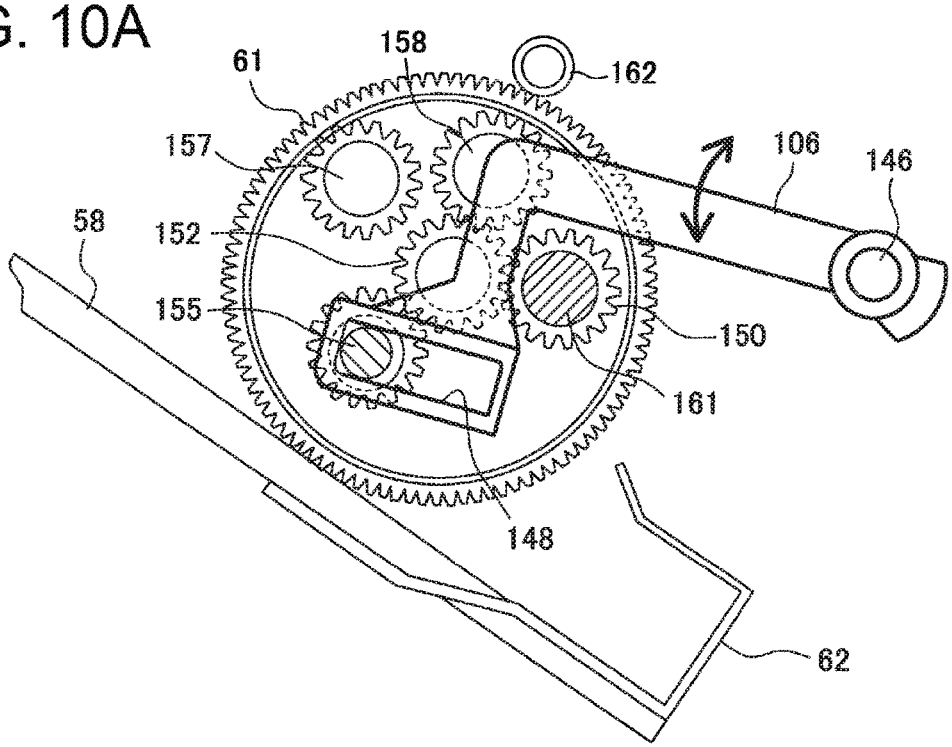
Figure 10B:
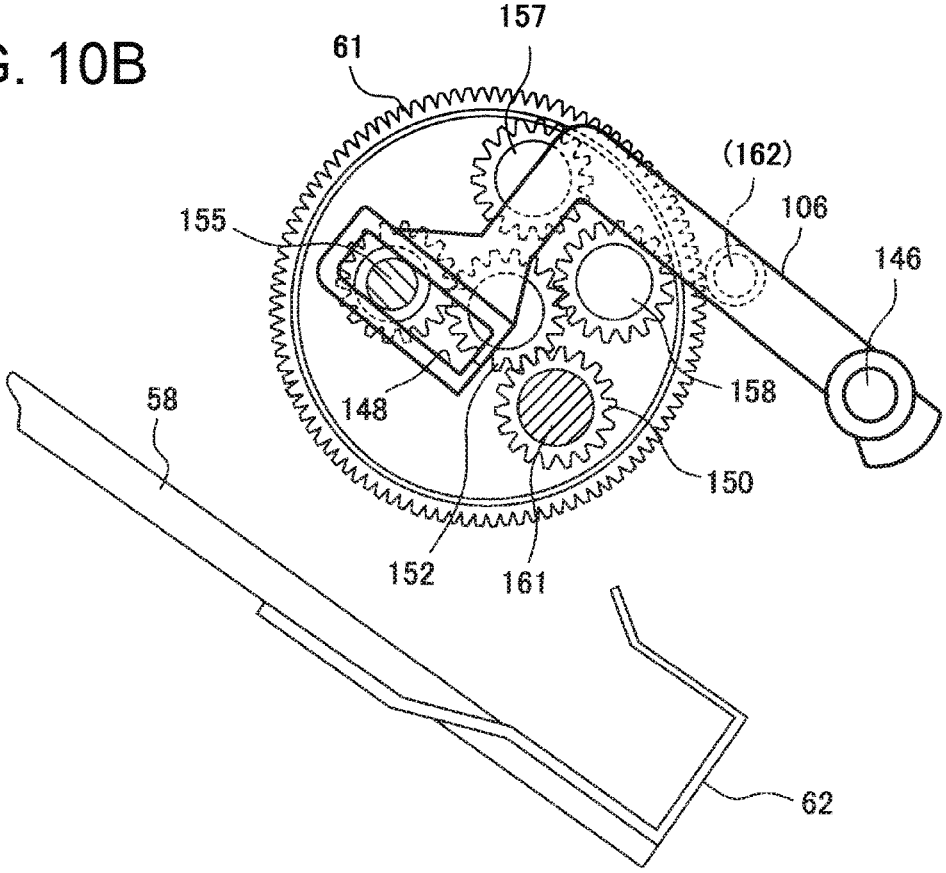

Lifting/lowering of the return belt 61 will be described using FIGS. 10A and 10B. FIG. 10A is a view illustrating a lowermost position of the return belt 61 at which the return belt 61 contacts the processing tray 58, and FIG. 10B is a view illustrating a state where the return belt 61 is separated from the processing tray 58. As described above, the return belt arm 106 lifted/lowered by the return belt lifting motor 105M has a slit part 148 at the crank shape, and the lower gear arm engagement shaft 155 of the in-belt lower gear 154 is loosely fitted to the slit part 148. When the return belt arm 106 is moved in the direction denoted by the arrow of FIG. 10A, the return belt 61 is turned upward about the belt lift-turning shaft 161.

FIG. 10A illustrates the position of the return belt 61 when the return belt 61 loads first several sheets on the processing tray 58, and FIG. 10B illustrates the position of the return belt 61 when the return belt 61 is lifted for receiving a number of sheets. In FIGS. 10A and 10B, illustration of the sheets is omitted. The belt pressing roller 162 provided opposite to the in-belt upper gear 158 that transmits the counterclockwise rotary drive to the return belt 61 is configured to always nip the return belt 61 together with the in-belt upper gear 158 at any height position. The relationship between the number of sheets loaded and the position of the return belt 61 whose lower surface contacts the sheet will be described below.

[Lifting/lowering of Sheet Discharge Roller/Return Paddle/Return Belt]

Hereinafter, lifting/lowering of the upper discharge roller 52*a*, return paddle 51, and the return belt 61 will be described using FIGS. 11 to 14. As described above, the upper discharge roller 52*a* and the return paddle 51 are mounted to the roller arm 50 as a transfer member, so that the height positions of the upper discharge roller 52*a* and return paddle 51 are set according to turning of the roller arm 50. Further, the height position of the return belt 61 is also set according to turning of the return belt arm 106 as a transfer member.

Figure 11:
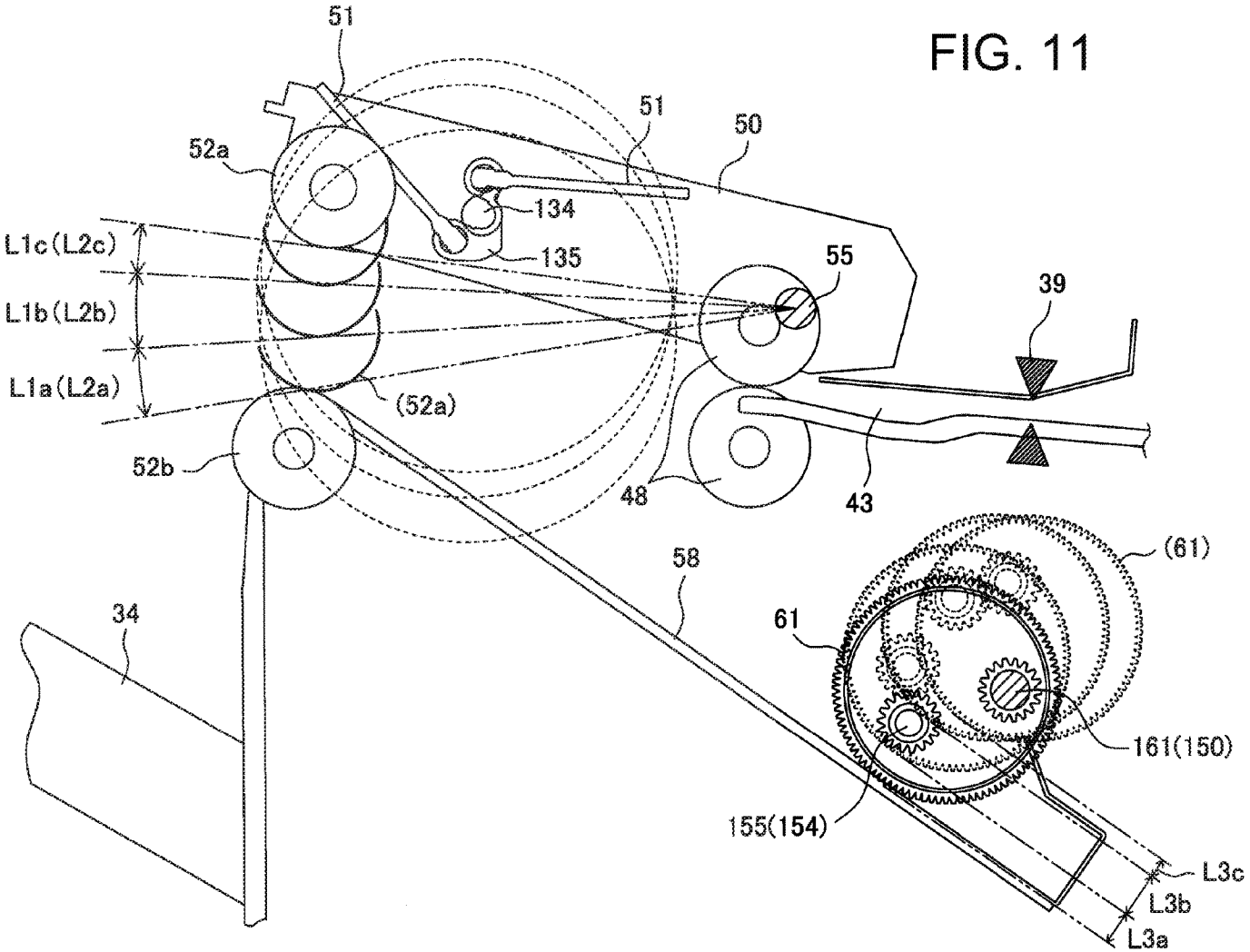
FIG. 11 is an explanatory view illustrating a state where the sheet discharge roller, the return paddle, and the return belt are each lifted in three stages.

As described above, when a first sheet is carried out by the conveying roller 48 onto the processing tray 58, the upper discharge roller 52*a* nips the sheet together with the lower discharge roller 52*b* to switch-back convey it toward the reference stopper 62. At this time, as illustrated in FIG. 11, the two elastic pieces of the return paddle 51 face upward, so that no interference is caused to the carry-in of the first sheet. For the second and subsequent sheets, sheet nipping by the upper discharge roller 52*a* is not performed to prevent occurrence of the "offset", but the return paddle 51 is rotated in the counterclockwise direction for switch-back conveyance.

When the number of sheets loaded on the processing tray 58 is increased by the above switch-back conveyance, the upper discharge roller 52*a*, return paddle 51, and return belt 61 are moved in the sheet thickness direction (direction separated from the surface of the processing tray 58) so as to keep the distance from the sheet constant. In this movement, the following operation is performed in the apparatus disclosed herein.

Figure 12:
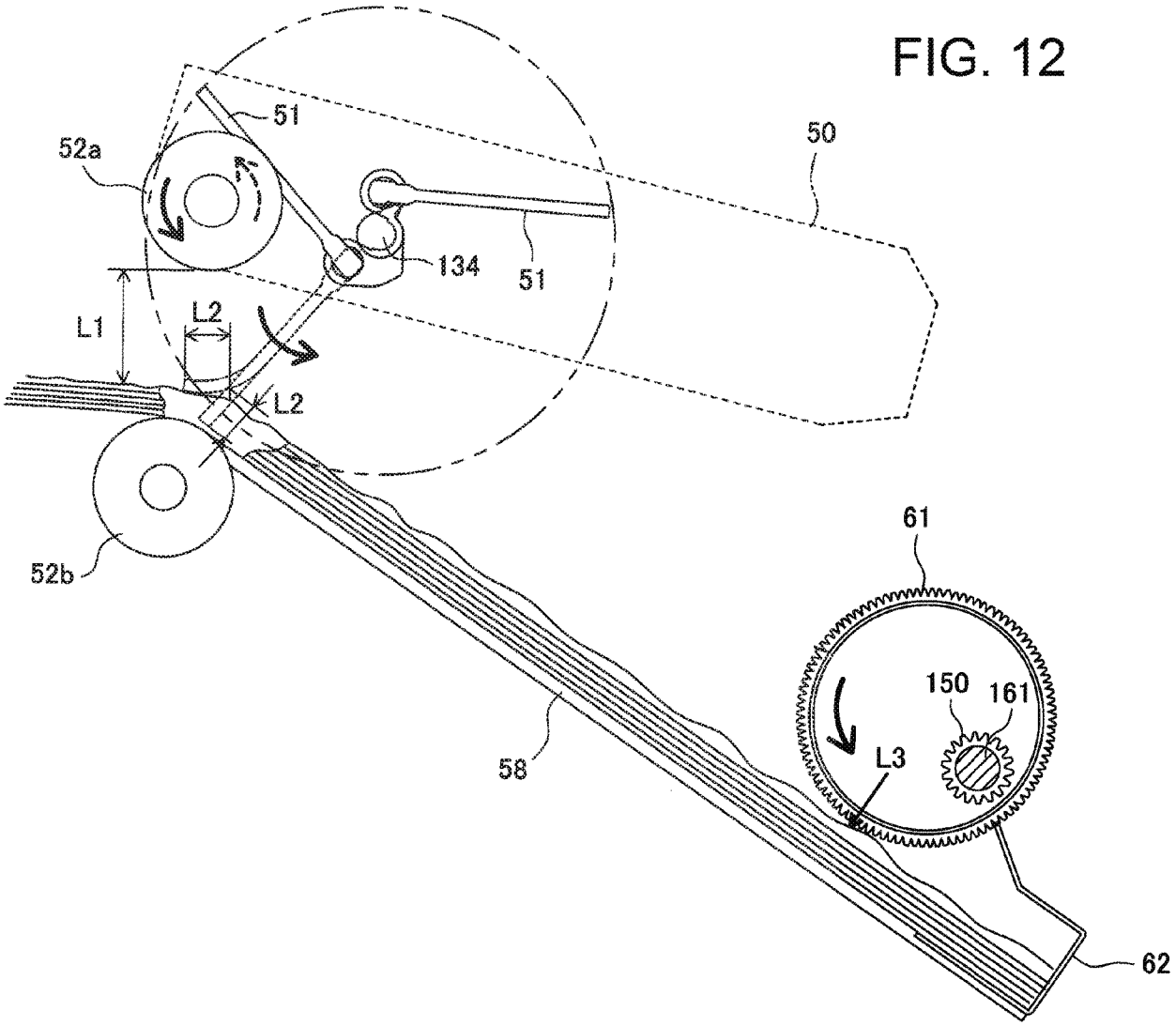
FIG. 12 is a view illustrating the positional relationship between a sheet loaded on the processing tray and the sheet discharge roller, the return paddle, and the return belt.

That is, as illustrated in FIG. 12, the upper discharge roller 52*a* is separated from the second sheet being carried out with the positional relationship (separation distance/clearance) L1. As illustrated in FIG. 11, the clearance L1 includes three lifting areas: upper discharge roller first lifting area L1*a*; upper discharge roller second lifting area L1*b*; and upper discharge roller third lifting area L1*c*.

The elastic piece of the return paddle 51 contacts the loaded sheet to be elastically deformed as illustrated in FIG. 12. A range of the deformation, in other words, an overlap range (overlap amount L2) where the elastic piece and the sheet overlap each other includes three lifting areas: return paddle first lifting area L2*a*; return paddle second lifting area L2*b*, and return paddle third lifting area L2*c* as illustrated in FIG. 11.

Further, the return belt 61 has a contact relationship L3 (degree of contact (comparatively low contact pressure, high contact pressure, etc.) with the surface of the sheet loaded on the processing tray 58) with the sheet surface as illustrated in FIG. 12. The contact relationship L3 includes three lifting areas: return belt first lifting area L1*a*; return belt second lifting area L3*b*, and return belt third lifting area L3*c*. In the apparatus disclosed herein, areas denoted by "c" i.e., the upper discharge roller third lifting area L1*c*, return paddle third lifting area L2*c*, and return belt third lifting area L3*c* each indicate an area where it is most distant from the sheet to exert little action on the sheet.

Figure 14:
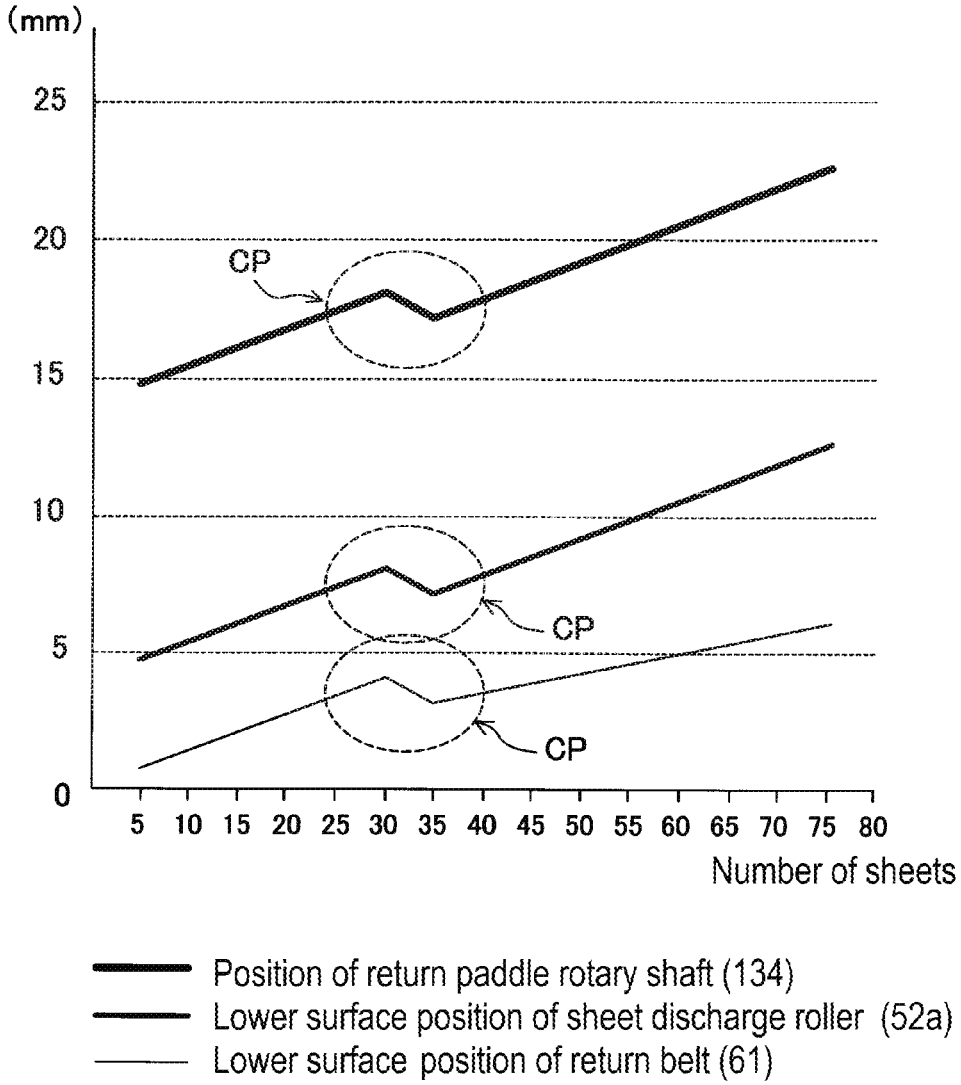
FIG. 14 is a graph corresponding to the table of FIG. 13.

The upper discharge roller 52*a*, return paddle 51, and return belt 61 each take the above three areas and lifted in a manner shown in the table of FIG. 13 and graph of FIG. 14 corresponding to the table of FIG. 13 according to the number of sheets loaded on the processing tray 58. The areas of "c" are positions most distant from the sheet (i.e., retreated positions) and have little relation to the number of sheets, so descriptions thereof will be omitted here.

The table of FIG. 13 shows the relationship with the number of sheets. In this table, the separation distance between the lower surface of the upper discharge roller 52*a* and the sheet is represented by a clearance (L1). The number of sheets is increased by five up to 75 (vertical direction of the table). The column area "a" to the left of the columns indicating the number of sheets refers to the L1*a*, L2*a*, and L1*a*, and the column area "b" refers to the L1*b*, L2*b*, and L3*b*.

As can be seen from the table, the upper discharge roller 52*a* is lifted by 4 mm in increments of five sheets until the number of sheets is increased up to 30 (i.e., in the area "a"). When the number of sheets exceeds 30, the lifting range is reduced, and the upper discharge roller 52*a* is lifted by 2.5 mm. In other words, as shown in the column to the right of the column showing the separation distance, assuming that the separation distance (4 mm) until the number of sheets reaches 30 is set to 1, the upper discharge roller 52*a* is lifted at a lifting rate of about 63%. In this manner, the lifting rate per five sheets is reduced at the time when the number of sheets exceeds a predetermined number of sheets (in this case, 30 sheets).

The return paddle 51 mounted to the roller arm 50 common to the upper discharge roller 52*a* is lifted in the same manner as the upper discharge roller 52*a*. As illustrated in FIG. 12, the return paddle 51 conveys the sheet to the reference stopper 62 with the tip end of the elastic piece thereof bent due to abutment with the sheet. The bending range (apparent overlap B) of the return paddle 51 is set to 7 mm until the number of loaded sheets reaches 30. Then, until the number of sheets increased from 30 to 75, the bending range is increased to 8.5 mm from 7 mm. Thus, assuming that the overlap rate of 7 mm until the number of loaded sheets reaches 30 is set to 1, it is increased to about 121%.

The upper discharge roller 52*a* and the return paddle 51 are mounted to the roller arm 50 as a common transfer member, that is, the lifting rate of the roller arm 50 is reduced when the number of sheets exceeds 30. As a result, when the number of loaded sheets exceeds 30, the conveying force of the return paddle 51 for sheet conveyance is increased. In this state, the return paddle 51 pushes the switch-back conveyed sheet in the same direction as the upper discharge roller 52*a* on the processing tray 58 conveys the sheet toward the reference stopper 62. This makes it possible to reduce occurrence of shortage of sheet conveying distance (stop of the sheet before reaching the reference stopper 62) even when a wavy sheet ("fluffy" sheet) is used.

Further, in the present invention, the return belt 61 that contacts the upper surface of the sheet near the reference stopper 62 to convey the sheet to the reference stopper 62 is lifted in the same manner as the upper discharge roller 52*a* and return paddle 51 by the return belt arm 106. That is, as can be seen from the rightmost column of the table of FIG. 13, assuming that the return belt 61 contacts the sheet substantially by its own weight (the lifting rate (L3) in this case is set to 1), the lifting rate of the return belt 61 when the number of sheets exceeds 30 is set (reduced) to 63% thereof, with the result that the weight applied to the sheet is increased. Thus, the sheet is conveyed to the reference stopper 62 while receiving stronger conveying force. This reduces occurrence of shortage of sheet conveying distance (stop of the sheet before reaching the reference stopper 62) even when a wavy sheet ("fluffy" sheet) is used.

FIG. 14 is a graph corresponding to the table of FIG. 13 which is made from a viewpoint different from that of the table of FIG. 13. In the graph of FIG. 14, along the vertical axis, the position of the return paddle rotary shaft 134, the position of the lower surface of the upper discharge roller 52*a*, and the position of the lower surface of the return belt 61 are plotted in this order from the top. The horizontal axis represents the number of sheets loaded on the processing tray 58. That is, the graph represents how the return paddle rotary shaft 134, the lower surface of the upper discharge roller 52*a*, and the lower surface of the return belt 61 are lifted with the increase in the number of sheets.

As can be seen from the graph, the lines corresponding to the positions of the return paddle rotary shaft 134, lower surface of the upper discharge roller 52*a*, and lower surface of the return belt 61 each have a change point CP (surrounded by a dashed ellipse) different in inclination from that seen before the number of loaded sheets reaches 30. That is, the above members 134, 52*a*, and 61 are once lowered to reduce the interval from the sheet so as to assist conveyance of the switch-back conveyed sheet with larger conveying force.

At the change point CP, the return paddle 51 is increased in overlap amount with the switch-back conveyed sheet, in other words, bending amount by the contact with the sheet so as to increase conveying force. Further, the lower surface of the return belt 61 is lowered so as to convey the sheet from the return paddle 51 to the reference stopper 62 with larger conveying force. Although not illustrated, for a normal sheet with little waviness, the lines corresponding to the positions of the return paddle rotary shaft 134, the lower surface of the upper discharge roller 52*a*, and the lower surface of the return belt 61 are increased substantially linearly without the change point CP in the graph of FIG. 14. As described above, in the present invention, the return paddle rotary shaft 134, lower surface of the upper discharge roller 52*a*, and lower surface of the return belt 61 each have the change point at which the lifting rate is changed, so that it is possible to convey even a wavy, so-called "fluffy" sheet to the reference stopper 62 with high accuracy, thus ensuring aligning property. Although the change point is set to appear at the time point when the number of sheets reaches 30 in the above description, the change point may be set to appear at the time point when the number of sheets reaches 20 or 40 according to the wavy state of the sheet.

[Sheet Type Detection Configuration]

Figure 15:
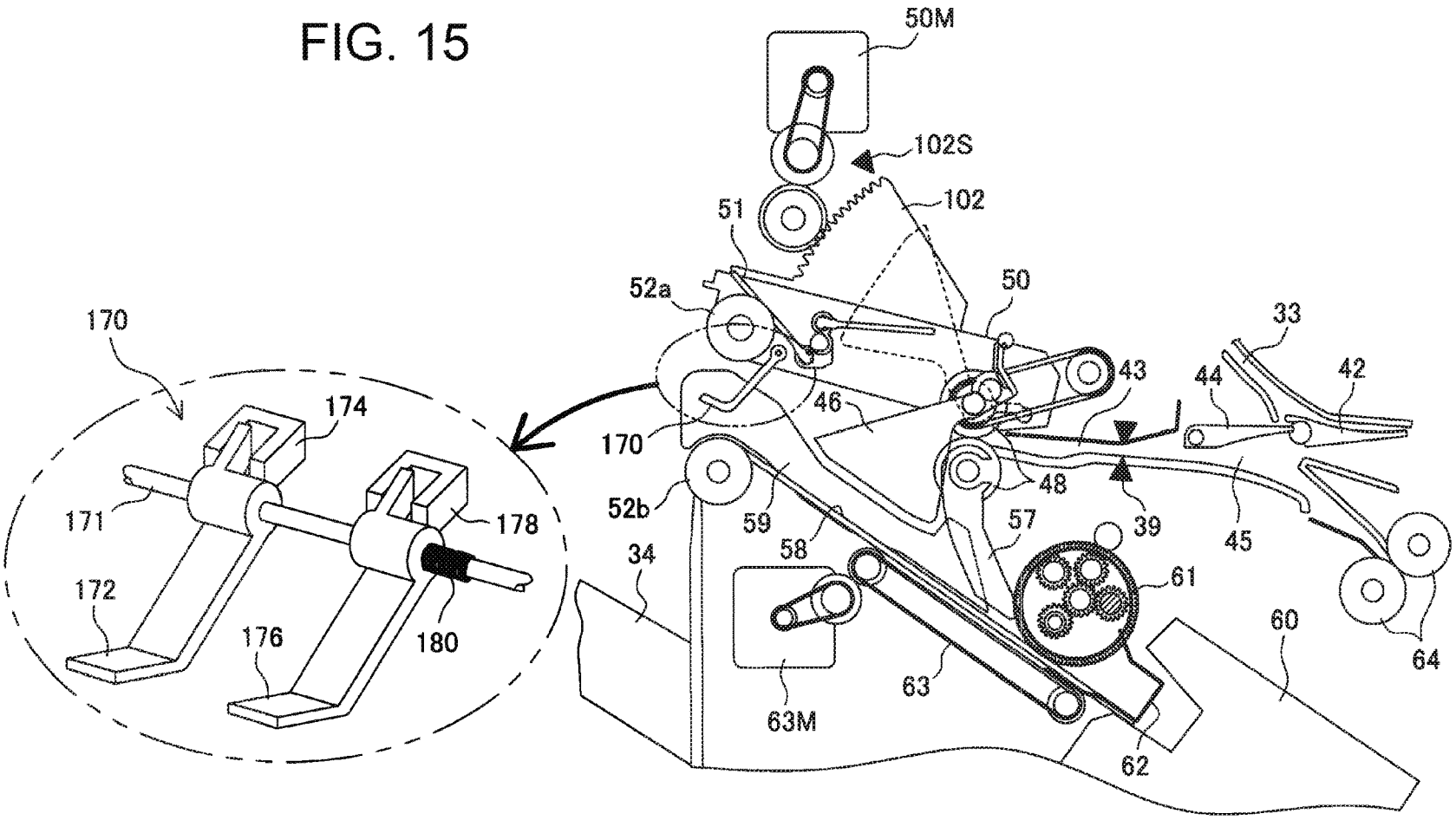
FIG. 15 is an explanatory view of the configuration of a sensor for detecting a sheet type on the processing tray.

A sheet detection configuration that detects whether a loaded sheet is a wavy, so-called "fluffy" sheet or a normal sheet with little waviness will be described using FIG. 15. FIG. 15 illustrates the processing tray 58 of FIG. 3 and its peripheral members. A sheet-type sensor 170 (surrounded by the long dashed double-short dashed line) is suspended from the roller arm 50.

As illustrated in an enlarged manner in FIG. 15, the sheet-type sensor 170 has a configuration in which a first type sensor flag 172 and a second type sensor flag 176 are turnably mounted to a sensor turning shaft 171 fitted to the roller arm 50 and configured to detect these flags using a first type sensor 174 and a second type sensor 178, respectively. As illustrated, the second type sensor flag 176 has a second type sensor spring 180 at a portion between itself and the sensor turning shaft 171. When the roller arm 50 is lowered to a sheet loaded on the processing tray 58, the first type sensor flag 172 suspended substantially by its own weight is quickly moved, and the movement thereof is detected by the first type sensor 174.

The second type sensor flag 176 is moved against the second type sensor spring 180 when the sheet is a sheet with little waviness, and the second type sensor 178 detects movement of the second type sensor flag 176 with a small time lag. On the other hand, when the sheet is a wavy and "fluffy" sheet, the second type sensor flag 176 receives resistance of the second type sensor spring 180, so that the second type sensor 178 detects movement of the second type sensor flag 176 with a time lag from the detection of movement of the first type sensor flag 172 by the first type sensor 174. Thus, it is possible to detect the degree of waviness of the loaded sheet according to the magnitude of the time lag.

In the present invention, the roller arm 50 is once lowered at the time point when about five sheets are accumulated on the processing tray 58 for the above detection of the time lag. According to the detected time lag, it is detected whether the loaded sheet is a wavy and "fluffy" sheet or not, and the lifting rates of the respective roller arm 50 supporting the upper discharge roller 52*a* and return paddle 51 and the return belt 61 are adjusted. In the described embodiment, the sheet-type sensor 170 is provided in the sheet processing apparatus B; however, an operator may input information indicating whether the loaded sheet is a wavy sheet or not to the image forming main body apparatus A1 or the sheet processing apparatus B. Further, the detection may be made when 10 or 15 sheets are accumulated on the processing tray 58.

[Sheet Loading to Processing Tray]

A flow of sheet loading when a sheet to be loaded in the sheet processing apparatus B disclosed herein will be described using FIGS. 16 to 18. When processing of storing a sheet from the conveying path 43 into the processing tray 58 is started, the sheet is carried in by the conveying roller 48 (S10). Subsequently, at the timing when the rear end of the sheet is carried out from the conveying roller 48, the drop-in guide 46 is moved toward the processing tray 58 to drop the sheet downward (S20).

When the sheet carried in by the conveying roller 48 is a first sheet, the roller arm 50 is lowered to bring the upper discharge roller 52*a* into pressure contact with the lower discharge roller 52*b* to switch-back convey the sheet toward the reference stopper 62 by the backward rotation (S30). In this case, the return paddle 51 is not rotated, and both the two fin-shaped elastic pieces are made to stand by at its initial position at which they are directed upward so as not to interfere with carry-out and switch-back conveyance of the first sheet as illustrated in FIGS. 3, 4, and 6.

When the second and subsequent sheets are carried into the processing tray 58 by the conveying roller 48 for switch-back conveyance, the upper discharge roller 52*a* is moved to a position (L1 of FIG. 12) separated by 4 mm from the sheet until the number of loaded sheets reaches five and rotated backward in the sheet switch-back direction. At this time, the upper discharge roller 52*a* is rotated in the switch-back direction to assist the sheet conveying operation of the return paddle 51 described below.

The return paddle 51 is rotated in such a direction that it conveys the sheet to the reference stopper 62 at the timing when the second sheet is carried out by the conveying roller 48 and dropped by the drop-in guide 46. At this time, the roller arm 50 is positioned such that the overlap amount (L2) between the fin-shaped elastic piece of the return paddle 51 and the sheet is 7 mm as denoted by the long dashed double-short dashed line (S40). This position is maintained until the number of sheets reaches five.

The sheet is conveyed on the processing tray 58 by the above return paddle 51 and is guided by the carry-in guide 57. Then, the sheet is made to abut against the reference stopper 62 by the return belt 61 that has already been constantly rotated in the direction toward the reference stopper 62 to be aligned (S50). The contact position between the return belt 61 and the sheet is set to a sheet bundle thickness position (L3 of FIG. 12) per five sheets in the apparatus disclosed herein. Thereafter, the aligning plates 59 are moved in a mutually approaching direction to align the sheet bundle in the width direction. A series of the above operations is repeated until the number of sheets reaches five, and then it is determined whether or not the number of sheets has reached five (S60).

When it is determined that the number of sheets has reached five, the roller arm 50 is lowered with the return paddle 51 maintained at its initial position (S70) so as to allow the sheet-type sensor 170 to detect whether the sheet is a wavy sheet or a normal sheet (S80). The detection operation of the sheet-type sensor 170 has already been described using FIG. 15 and is therefore omitted here. The sheet-type detection may be performed without use of the sheet-type sensor 170. That is, an operator may previously input sheet-type information to a control panel 26, or the sheet-type information may be acquired from the image forming main body apparatus A1. Depending on whether the sheet is a wavy sheet or not, the processing flow proceeds to routine A or B.

[Sheet Loading to Processing Tray (Wavy Sheet)]

Figure 16:
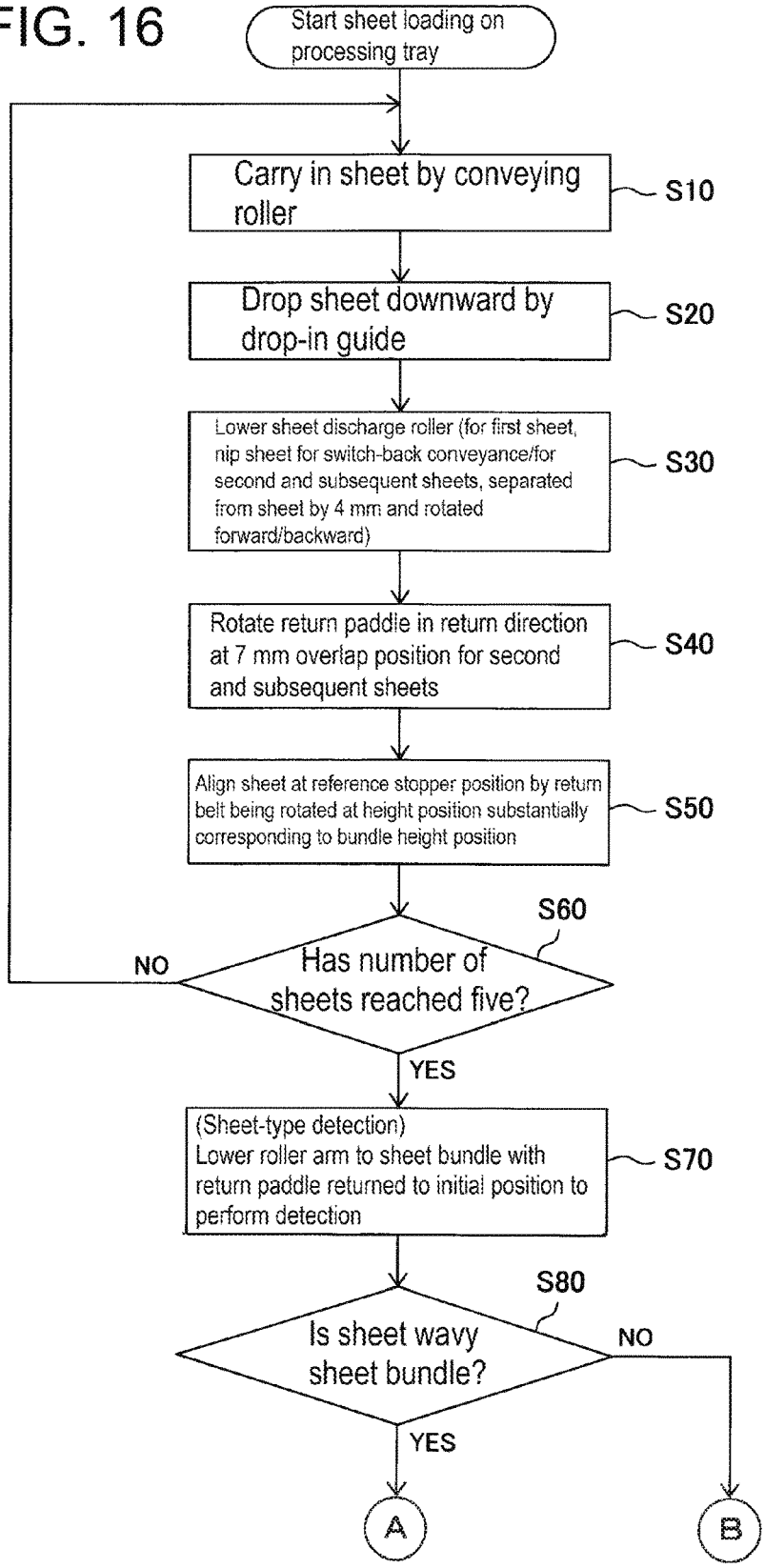
FIG. 16 is a flowchart of sheet loading onto the processing tray according to the present invention.
Figure 17:
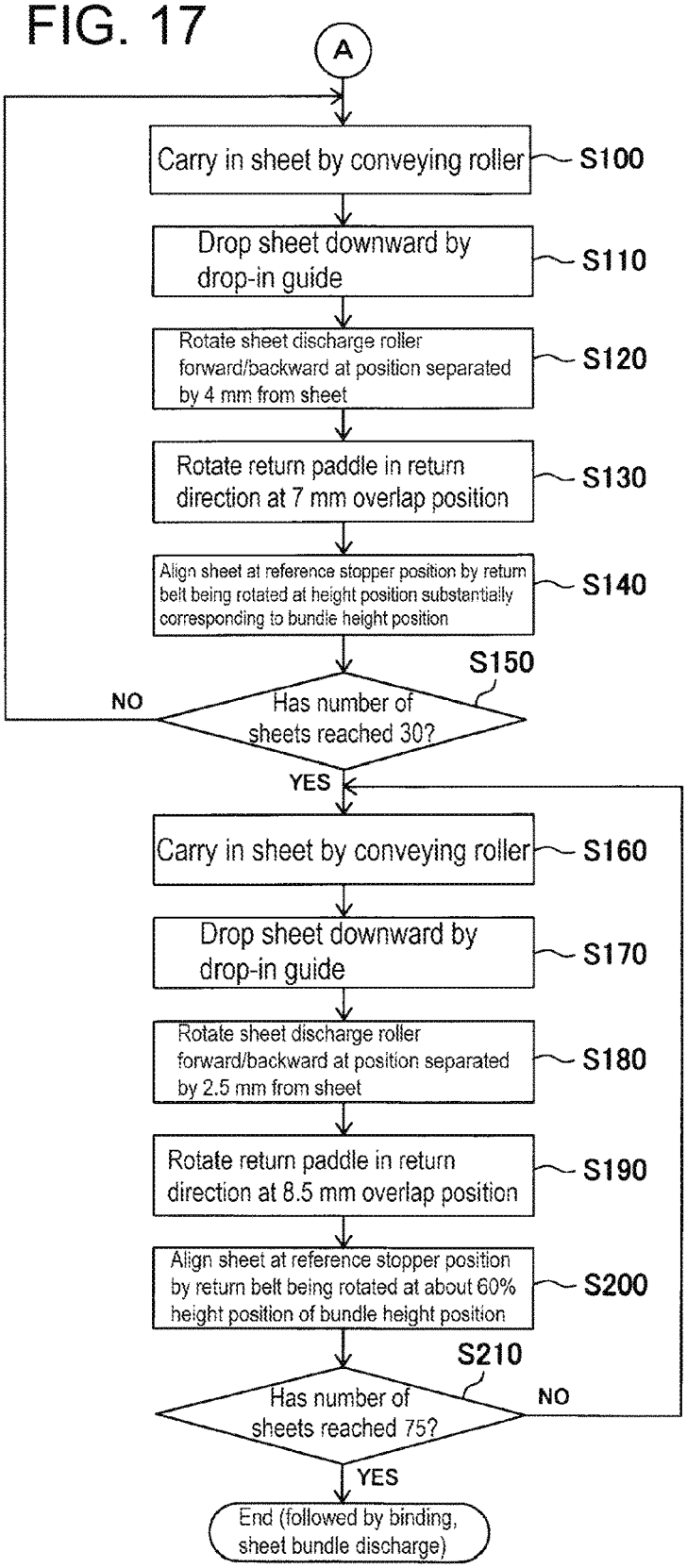
FIG. 17 is a flowchart of sheet loading onto the processing tray (continued from FIG. 16)

When it is determined that the sheet is a wavy sheet, the processing flow proceeds to routine A of FIG. 17. The processing from S100 to S140 is the same as the processing from S10 to S50 (FIG. 16) for the second and subsequent sheets. That is, until the number of sheets reaches 30, the upper discharge roller 52*a* is positioned at a position (clearance L1 position) separated by 4 mm from the sheet every time the number of sheets is increased by five, the elastic piece of the return paddle 51 is set to a 7 mm overlap position (L2), and the return belt 61 is set to a position substantially corresponding to the bundle height position (L3) (S100 to S140).

When the number of sheets loaded on the processing tray 58 reaches 30, sufficient conveying force cannot be applied to the sheet under the above conditions due to waviness of the carried-in sheet. Then, after carry-in of the sheet by the conveying roller 48 (S160), the drop-in guide 46 is moved downward to drop the sheet (S170), and the roller arm 50 is lowered so as to locate the lower surface of the upper discharge roller 52*a* at a position separated by 2.5 mm (clearance L1 position) from the sheet as illustrated in FIGS. 13 and 14 every time the number of sheets is increased by five. That is, the separation distance is changed from 4 mm to 2.5 mm. Thus, the upper discharge roller 52*a* is rotated forward/backward at sheet carry-in or switch-back conveyance to assist sheet conveyance (S180).

Further, the apparent overlap of the two fin-shaped elastic pieces of the return paddle 51, in other words, as illustrated in FIG. 12, the bending area (L2) of the tip end of the return paddle 51 is set to 8.5 mm (S190). This generates stronger conveying force and prevents the wavy sheet from running off from the return paddle 51, whereby switch-back conveyance can be reliably carried out.

Further, in the apparatus disclosed herein, the position of the lower surface of the return belt 61 provided near the reference stopper 62 is set to a position (L3) lowered to about 60% of the sheet bundle thickness (up to 30 sheets). Thus, the return belt 61 can convey the wavy sheet to the reference stopper 62 by applying stronger conveying force to the sheet (S200).

When the number of sheets loaded on the processing tray 58 reaches 75, the sheet loading on the processing tray 58 is ended, and the sheet bundle is bound and discharged to the loading tray 34. There may be a case where the number of sheets carried in to the processing tray 58 does not reach 30 or 75. For example, in a case where carry-in of the sheet to the processing tray 58 is completed at the time when 50 sheets are carried into the processing tray 58, the loading processing is changed at the time when the number of sheets exceeds 30, and when the number of sheets reaches 50, the sheet loading processing on the processing tray 58 is ended, and the sheet bundle is bound and discharged to the loading tray 34.

[Sheet Loading to Processing Tray (Normal Sheet)]

Figure 18:
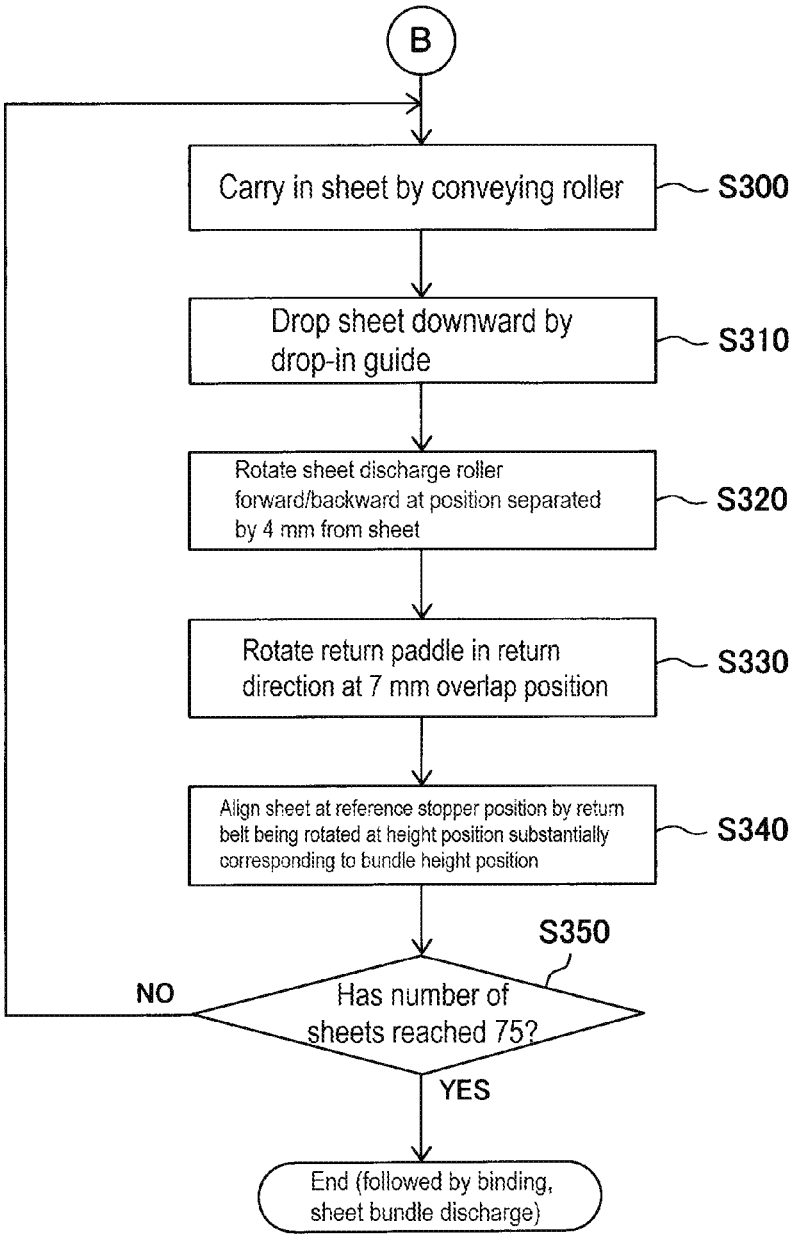
FIG. 18 is a flowchart of sheet loading onto the processing tray (continued from FIG. 17)

When it is determined in the sheet-type detection of FIG. 16 that the sheet is not a wavy sheet but a normal sheet, the processing flow proceeds to routine B of FIG. 18. The processing from S300 to S340 is the same as the processing from S10 to S50 (FIG. 16) for the second and subsequent sheets. That is, until the number of sheets reaches 75, the upper discharge roller 52*a* is located at a position (clearance L1 position) separated by 4 mm from the sheet every time the number of sheets is increased by five, the elastic piece of the return paddle 51 is set to a 7 mm overlap position (L2), and the return belt 61 is set to a position substantially corresponding to the bundle height position (L3) (S320 to S340).

When loading of the one sheet bundle is completed before the number of sheets reaches 75, the loading processing is ended, and the sheet bundle is bound and discharged to the loading tray 34. As described above, for the normal sheet with little waviness, even though the moving rate (distance from the sheet or overlap with the sheet) of the roller arm 50 every time the number of sheets is increased by five is not changed, it is possible to suppress buckling or rebounding of the sheet due to abutment on the sheet front end from the carry-in guide 57 or reference stopper 62 to thereby suppress deterioration in aligning property.

[Control Configuration]

Figure 19:
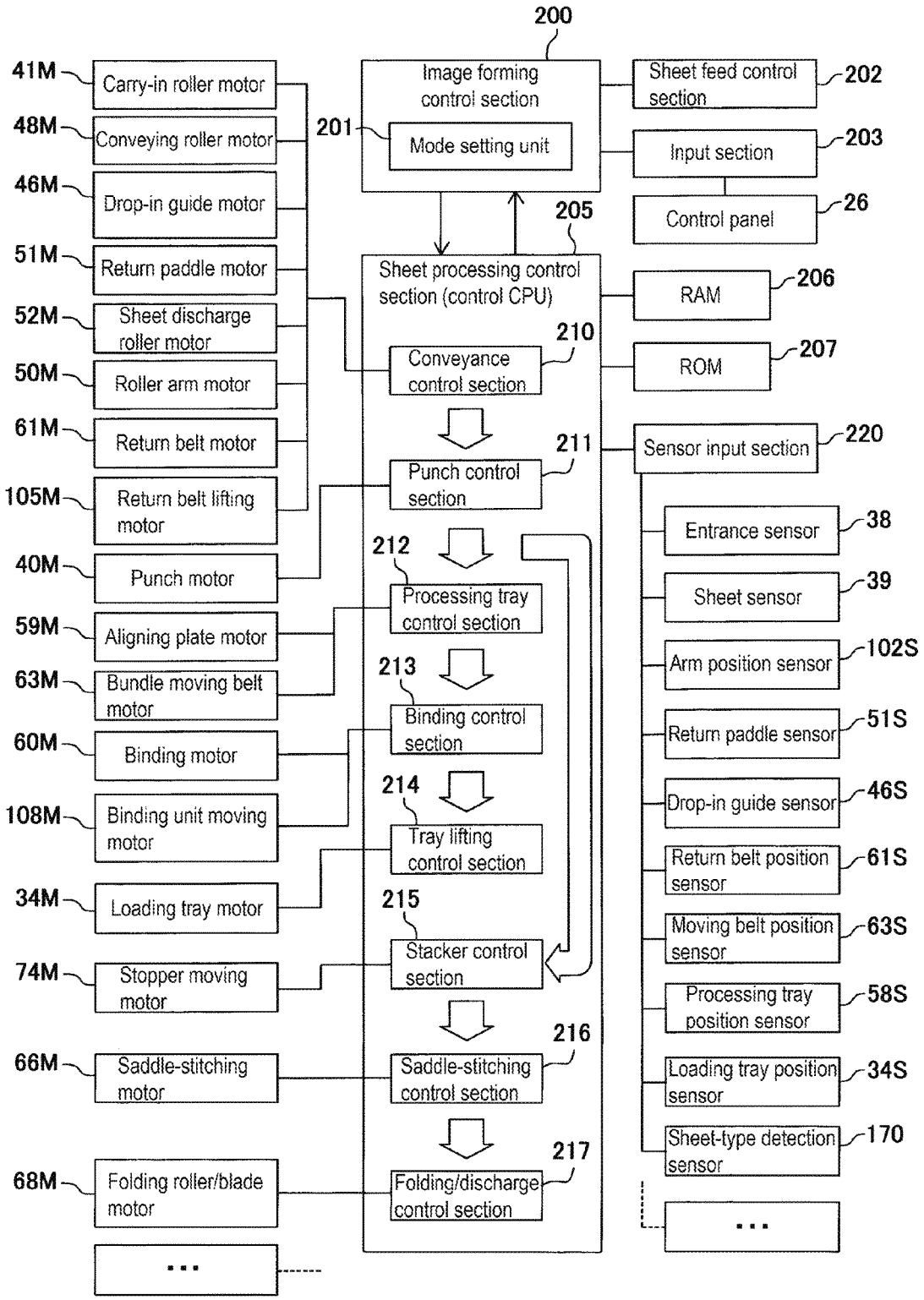
FIG. 19 is a block diagram of the apparatus according to the present invention.

A control configuration of the image forming apparatus A disclosed herein will be described using the block diagram of FIG. 19. The image forming apparatus A of FIG. 1 has an image forming control section 200 of the image forming main body apparatus A1 and a sheet processing control section 205 (control CPU) of the sheet processing apparatus B. The image forming control section 200 has a sheet feed control section 202 and an input section 203. On a control panel 26 provided in the input section 203, an operator can set the following modes: (1) printout mode; (2) jog sorting mode; (3) binding mode; and (4) book-binding (saddle-stitching) mode. Details of these modes will be described later.

The sheet processing control section 205 is a control CPU that operates the sheet processing apparatus B according to a sheet processing mode designated from among the above four modes. The sheet processing control section 205 has a ROM 207 that stores an operation program and a RAM 206 that stores control data. Further, the sheet processing control section 205 acquires detection information from a sensor input section 220.

[Sensor Input Section]

The sensor input section 220 has an entrance sensor 38 for detecting carry-in of an image-formed sheet from the image forming main body apparatus A1 and detects the front and rear ends of the sheet to thereby manage drive of motors. A sheet sensor 39 for detecting sheet jamming and the like is provided downstream of the entrance sensor 38.

The sensor input section 220 further has an arm position sensor 102S for detecting the lifting position of the roller arm 50 that is lifted/lowered while supporting the upper discharge roller 52*a* and the return paddle 51, a return paddle sensor 51S for detecting whether the return paddle 51 is at its initial position, a drop-in guide sensor 46S for detecting the position of the drop-in guide 46, and a return belt position sensor 61S for detecting the lifting position of the return belt 61.

Further, the sensor input section 220 has a bundle moving belt sensor 63S for detecting the position of a bundle moving belt 63 that moves the sheets that have been bound in a bundle on the processing tray 58 toward the sheet discharge roller 52, and a processing tray empty sensor 58S for detecting whether any sheet is present on the processing tray 58. Further, a loading tray position sensor 34S for detecting the surface of the loading tray 34 that accumulates thereon the sheet discharged by the sheet discharge roller 52 while being gradually lowered is provided.

In addition, the sensor input section 220 has the sheet-type sensor 170 (FIG. 15) for detecting whether the sheet loaded on the processing tray is a wavy and "fluffy" sheet or a normal sheet. There are further provided sensors for the punch unit 40, end face binding unit 60, and saddle-stitching unit 66 (descriptions thereof are omitted here).

[Output Section (Motors)]

The sheet processing control section 205 includes a conveyance control section 210 that controls sheet conveyance. The conveyance control section 210 controls a carry-in roller motor 41M for sheet carry-in, a conveying roller motor 48M for conveying a sheet to the processing tray 58, and a drop-in guide motor 46M for guiding a sheet to the processing tray 58. Further, the conveyance control section 210 controls a return paddle motor 51M for sheet switch-back conveyance, a sheet discharge roller motor 52M rotating forward/backward to move a sheet. Further, the conveyance control section 210 controls a roller arm motor 50M for the roller arm 50 that lifts the upper discharge roller 52*a* and the return paddle 51, a return belt motor 61M for driving the return belt 61, and a return belt lifting motor 105M for lifting the return belt 61, thereby controlling lifting position or lifting rate of the roller arm 50 and return belt 61. The lifting rate is set in a manner as described using FIGS. 11 to 14, and FIGS. 16 to 18.

A punch control section 211 is provided for punching the rear end of a sheet carried in by the carry-in roller 41. The punch control section 211 controls a punch motor that punches a sheet at a designated position in the sheet width direction. Further, a processing tray control section 212 controls an aligning plate motor 59M that moves the aligning plates 59 that sandwich a sheet from both sides in the sheet width direction to align it and a bundle moving belt motor 63M that moves a sheet bundle placed on the processing tray 58 together with the sheet discharge roller 52.

An end face binding control section 213 in the following stage controls a binding motor 60M for driving a known stapler at the end portion of a sheet bundle and bending the driven stapler and an end face binding unit moving motor 108M for moving the binding unit 60 to a designated position in the sheet width direction so as to achieve two-point binding or corner binding. The sheet bundle thus bound by the stapler at the end portion thereof is discharged to the loading tray 34 by the bundle moving belt 63 and sheet discharge roller 52. At this time, a loading tray motor 34M is controlled by a tray lifting control section 214 based on detection made by a loading tray position sensor 34S so as to keep the position of the upper surface of the sheet bundle with respect to the sheet discharge port 54 constant at all times.

When performing bookbinding (saddle-stitching) to be described later, the conveying roller 48 is rotated backward to switch-back convey the sheet on the processing tray 58, and the switch-back conveyed sheet is conveyed to a saddle-stitching path 65 by the branch roller 64. Then, the conveyed sheet abuts against a saddle-stitching sheet stopper 74. The position of the saddle-stitching sheet stopper 74 is previously set to a position corresponding to the carried-in sheet length by a stacker control section 215 driving a stopper moving motor 74M. After stacking of a predetermined number of sheets, the saddle-stitching sheet stopper 74 is lifted, and the sheet bundle is folded in two at a saddle-stitching position by driving a folding roller/blade motor 68M controlled by a folding/discharge control section 217 and discharged to a bundle stacker 78 by the bundle discharge roller 76. In this manner, bookbinding (saddle-stitching) is performed.

[Sheet Processing Mode]

The sheet processing apparatus B is an apparatus that receives, through the entrance 36, a sheet carried out from the sheet discharge port 16 of the image forming main body apparatus A1 and processes the received sheet. The sheet processing apparatus B has the following four processing modes: (1) printout mode in which image-formed sheets are loaded/stored; (2) jog sorting mode in which image-formed sheets are aligned and stored; (3) binding mode in which image-formed sheets are aligned, accumulated, and bound; and (4) bookbinding (saddle-stitching) mode in which image-formed sheets are aligned, bound, and then folded into a booklet.

The following describes modifications partially different from the above embodiment. Modification 1 will be described using FIGS. 18 and 19, and Modification 2 will be described using FIGS. 20 and 21. In these modifications, the same reference numerals are given to the same or similar constituent elements to those of the above embodiment.

[Modification 1]

Figure 21:
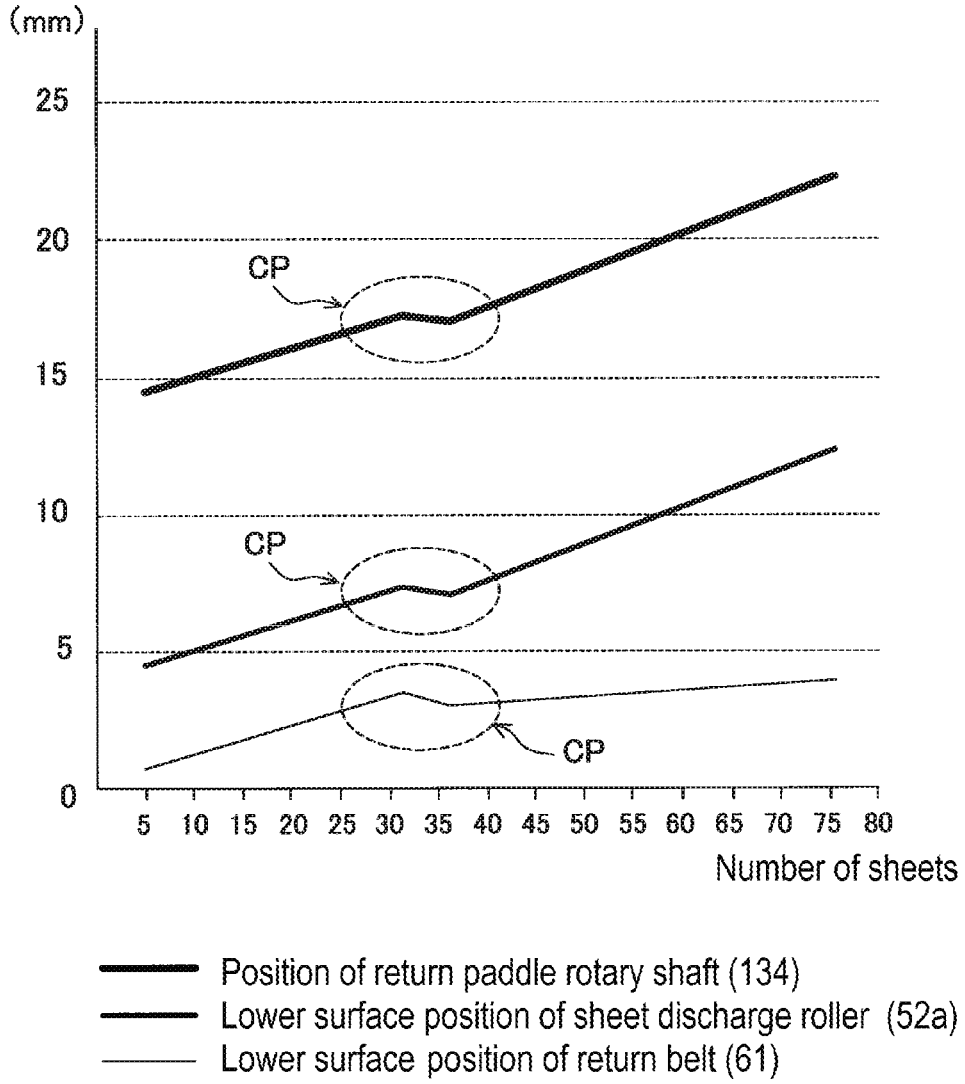
FIG. 21 is a graph corresponding to the table of FIG. 20.

FIGS. 20 and 21 are tables and graphs obtained by changing the lifting rates of the positions of the lower surface of the upper discharge roller 52*a* of the sheet discharge roller 52, return paddle rotary shaft 134, and lower surface of the return belt 61, respectively, shown in FIGS. 13 and 14. In FIGS. 13 and 14, the lower surface of the upper discharge roller 52*a* is positioned at a position separated by 4 mm from the sheet every time the number of sheets is increased by five until the number of sheets reaches 30, and the separation distance therebetween is changed to 2.5 mm after the number of sheets exceeds 30. On the other hand, in this modification, the lifting range is changed every time the number of sheets is increased by five, and there is provided a change point CP at which the position of the lower surface of the upper discharge roller 52*a* is once lowered at the time point when the number of sheets exceeds 30. Even in this configuration, shortage of the sheet conveying distance can be suppressed to allow even a wavy sheet to be conveyed to the reference stopper 62. The same is with the overlap rate between the return paddle 51 and the sheet and the lifting rate of the return belt 61. That is, the change point CP need not necessarily be provided, and it is sufficient to increase conveying force by suppressing the lifting rate or increasing the overlap rate according to increase in the number of loaded sheets.

[Modification 2]

Figure 22A:
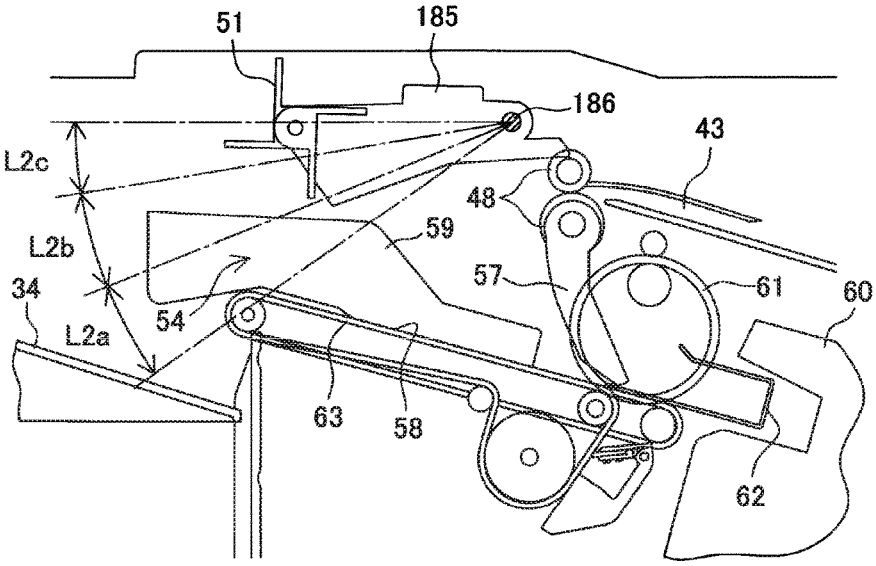
Figure 22B:
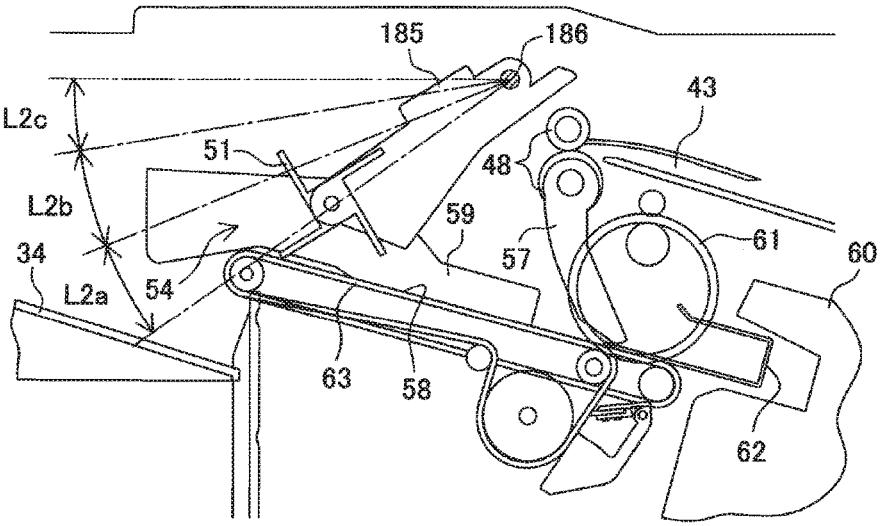
Figure 23A:
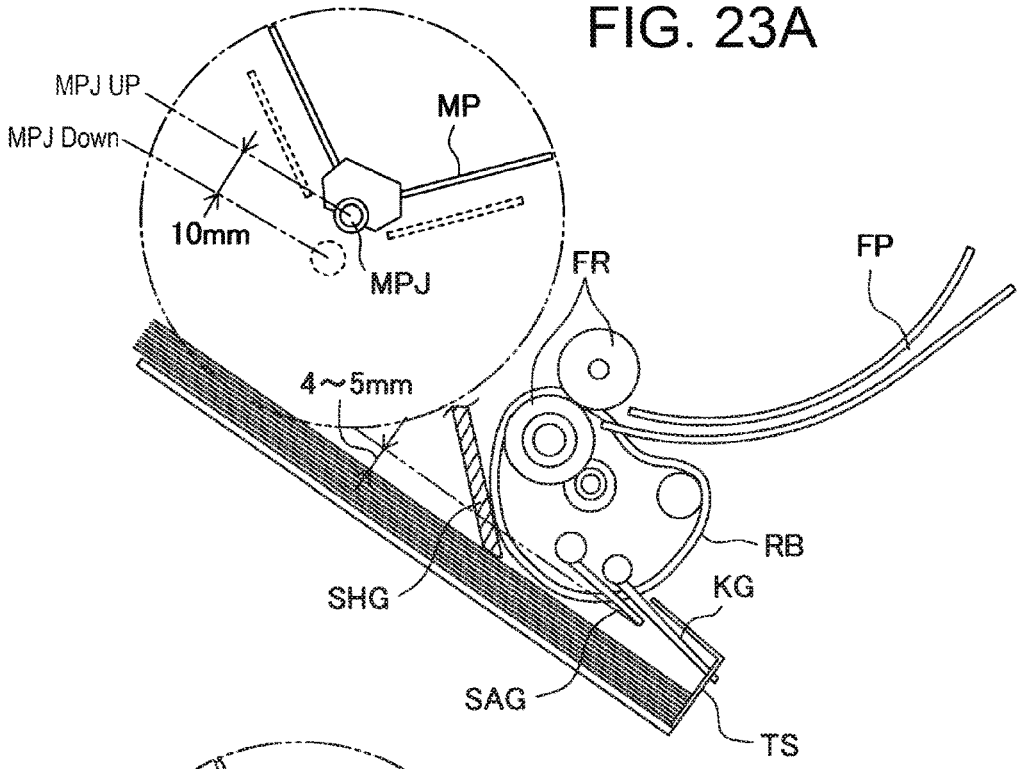
Figure 23B:
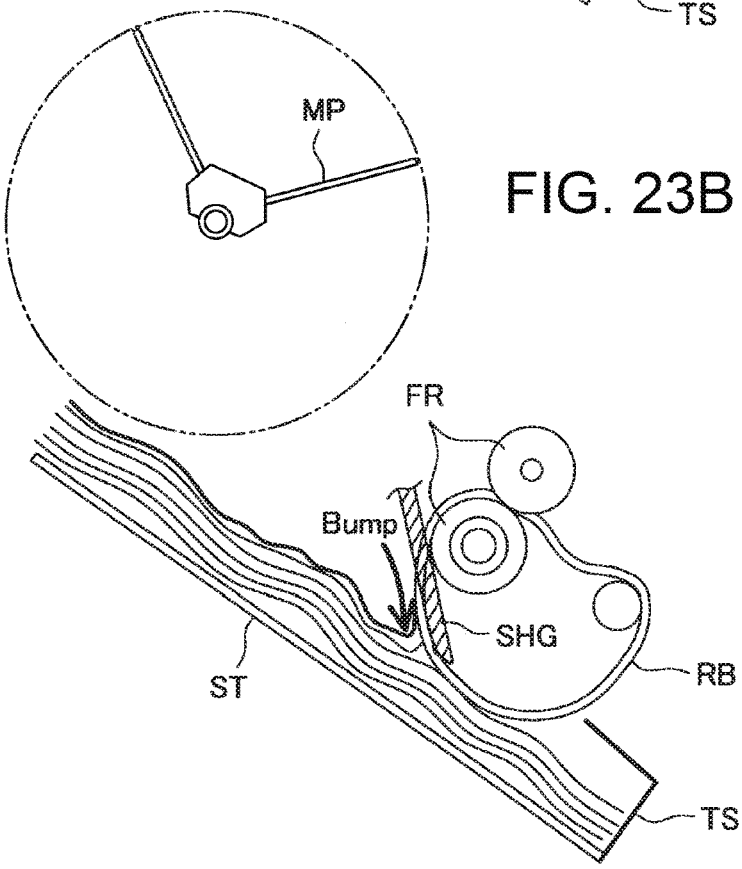
Figure 24:
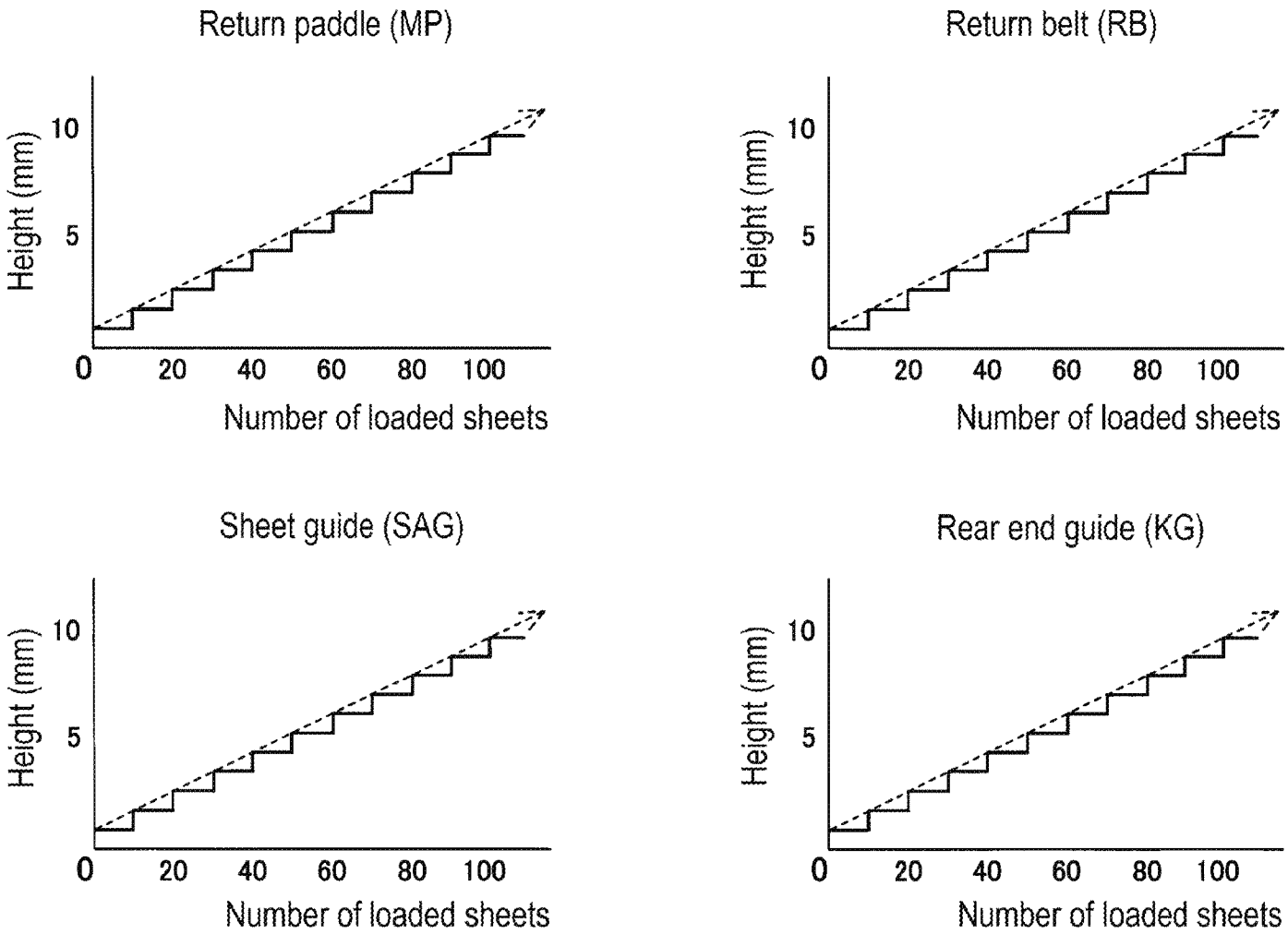
FIG. 24 is graphs each showing a state where a return paddle and the like of the conventional apparatus illustrated in FIG. 23A are moved at a constant rate every time the number of loaded sheets is increased by 10.

FIGS. 22A and 22B illustrate a configuration in which the sheet discharge roller 52 is not provided. In this configuration, a sheet carried out by the conveying roller 48 is switch-back conveyed by the return paddle 51 mounted to a return paddle arm 185 configured to be turned about a return paddle arm shaft 186. Also in this case, overlap range where the return paddle 51 and the sheet overlap each other includes three lifting areas: return paddle first lifting area L2*a* (small); return paddle second lifting area L2*b* (large); and return paddle third lifting area L2*c* (non-contact area).

FIG. 22A illustrates a state where the return paddle 51 is positioned at return paddle third lifting area L2*c* (non-contact area), and FIG. 22B illustrates a state where the return paddle 51 is positioned at return paddle first lifting area L2*a* (small). The return paddle 51 according to Modification 2 also has the lifting rate shown in FIGS. 13 and 14 or FIGS. 20 and 21. With this configuration, even a wavy sheet can easily reach the reference stopper 62.

[Other Modifications]

In the above embodiment and modifications, the lifting rate of the return paddle 51 provided in the processing tray 58 is changed; however, when a paddle is provided in the stacker section 72 so as to be movable from the sheet surface, the effects of the present invention can be obtained.

As described above, according to the embodiments disclosed herein, the following effects can be obtained.

(1) A sheet processing apparatus B that applies processing to a loaded sheet includes a conveying roller 48 that conveys a sheet, a processing tray 58 on which the sheet from the conveying roller is loaded, a reference member (reference stopper 62) provided at one end of the processing tray, a transfer member (return paddle 51) having an elastic piece for transferring the sheet from the conveying roller to the reference member, and a moving member (roller arm 50) that moves the transfer member in the sheet thickness direction at a predetermined moving rate according to the number of sheets loaded on the processing tray. The moving rate of the moving member is reduced as the number of sheets loaded on the processing tray is increased. With this configuration, even a sheet with large waviness (wavy sheet) can be conveyed to the reference member, thereby suppressing sheet aligning property from being deteriorated at sheet loading.

(2) In the sheet processing apparatus of (1), the transfer member is a paddle member (return paddle 51) having the elastic piece. The moving rate of the moving member is set to a first moving rate (moving amount of the return paddle 51 per five sheets) until the number of sheets loaded on the processing tray 58 reaches a predetermined value (30 sheets) and set to a moving rate (moving amount of the return paddle 51 per five sheets) lower than the first moving rate after the number of sheets exceeds the predetermined value. With this configuration, the paddle can apply larger conveying force to the wavy sheet.

(3) In the sheet processing apparatus of (2), the degree of engagement between the paddle member and the sheet is greater at the second moving rate of the moving member than at the first moving rate. With this configuration, a range where the paddle and the sheet is increased to thereby apply larger conveying force to the wavy sheet.

(4) In the sheet processing apparatus of (2), an overlap amount between the paddle member and the sheet is increased (from 7 mm to 8.5 mm) such that elastic deformation of the paddle member contacting the sheet becomes larger at the second moving rate of the moving member than at the first moving rate. With this configuration, the paddle and the sheet apparently overlap each other, thereby applying larger conveying force to the wavy sheet.

(5) In the sheet processing apparatus of (4), the paddle member (return paddle 51) is rotated in a direction that switch-back conveys the sheet conveyed from the conveying roller to the reference member (reference stopper 62). With this configuration, occurrence of shortage of sheet conveying distance is suppressed when a sheet to be switch-back conveyed to the processing tray 58 is the wavy sheet.

(6) A sheet processing apparatus B that applies processing to a loaded sheet includes a conveying roller 48 that conveys a sheet, a processing tray 58 on which the sheet from the conveying roller is loaded, a reference member (reference stopper 62) provided at one end of the processing tray, a transfer member (return paddle 51) having an elastic piece for switch-back conveying the sheet from the conveying roller to the reference member, a forward/backward rotatable sheet discharge roller (sheet discharge roller 52) that discharges the sheet loaded on the processing tray and assists conveyance of the sheet when the transfer member conveys the sheet to the reference member, and a moving member (roller arm 50) that moves the sheet discharge roller and the paddle member in the sheet thickness direction at a predetermined moving rate according to the number of sheets loaded on the processing tray. The moving rate of the moving member is reduced (the lifting rate of the upper discharge roller 52*a* per five sheets is reduced from 4 mm to 2.5 mm after the number of loaded sheets exceeds 30) as the number of sheets loaded on the processing tray is increased. With this configuration, the conveying force of the return paddle 51 is increased, so that even a sheet with large waviness (wavy sheet) can be conveyed to the reference member, thereby suppressing sheet aligning property from being deteriorated at sheet loading.

(7) In the sheet processing apparatus of (6), the transfer member is a paddle member (return paddle 51) having an elastic piece. The moving member (roller arm 50) is a support arm configured to be moved while supporting the paddle (return paddle 51) and the sheet discharge roller (upper discharge roller 52*a*). When the paddle member is rotated, the sheet discharge roller is also rotated in the same direction as the paddle member. With this configuration, the return paddle 51 and the upper discharge roller 52*a* can be supported by the common roller arm 50. Further, the upper discharge roller 52*a* is used to perform assistive conveyance, whereby aligning property of the wavy sheet can be improved.

(8) In the sheet processing apparatus of (7), the moving rate of the support arm is set to a first moving rate (the upper discharge roller 52*a* is lifted by 4 mm every time the number of loaded sheets is increased by five) until the number of sheets loaded on the processing tray reaches a predetermined value (30 sheets) and set to a moving rate (the upper discharge roller 52*a* is lifted by 2.5 mm every time the number of loaded sheets is increased by five) lower than the first moving rate after the number of sheets exceeds the predetermined value (30 sheets). With this configuration, the conveying force of the sheet discharge roller 52 and return paddle 51 is increased with increase in the number of loaded sheets, thereby improving aligning property of even the wavy sheet.

(9) In the sheet processing apparatus of (8), an overlap amount between the sheet and the paddle member when they contact each other is larger at the second moving rate of the support arm (roller arm 50) than at the first moving rate (8.5 mm at the second moving rate, and 7 mm at the first moving rate), and a separation distance between the sheet discharge roller and the sheet is smaller at the second moving rate of the support arm (roller arm 50) than at the first moving rate (2.5 mm at the second moving rate, and 4 mm at the first moving rate). With this configuration, the conveying force of the return paddle 51 and the assistive conveying force of the upper discharge roller 52*a* are increased, so that even the wavy sheet can be reliably conveyed.

(10) A sheet processing apparatus B that applies processing to a loaded sheet includes a conveying roller 48 that conveys a sheet, a processing tray 58 on which the sheet from the conveying roller is loaded, a reference member (reference stopper 62) provided at one end of the processing tray, a transfer member (return paddle 51) having an elastic piece for switch-back conveying the sheet from the conveying roller to the reference member, a return conveying member (return belt 61) that contacts the sheet conveyed by the transfer member to convey it to the reference member, and moving members (roller arm 50, return belt arm 106) that move the transfer member and the return conveying member, respectively, in the sheet thickness direction at a predetermined moving rate according to the number of sheets loaded on the processing tray. The moving rates of the moving members are reduced as the number of sheets loaded on the processing tray is increased. With this configuration, aligning property of even a sheet with large waviness (wavy sheet) can be suppressed from being deteriorated at sheet loading.

(11) In the sheet processing apparatus of (10), the transfer member is a paddle member (return paddle 51) having an elastic piece. The return conveying member is an endless belt member (return belt 61). The moving rates of the moving members are set to a first moving rate until the number of sheets loaded on the processing tray reaches a predetermined value (30 sheets) and set to a second moving rate lower than the first moving rate after the number of sheets exceeds the predetermined value. With this configuration, the lifting rates of the return paddle 51 and return belt 61 are reduced, so that aligning property deterioration that may occur at sheet loading because of shortage of sheet conveying distance can be suppressed even if the sheet shows large waviness (wavy sheet).

(12) In the sheet processing apparatus of (11), an overlap amount between the paddle member and sheet is increased (from 7 mm to 8.5 mm) such that elastic deformation of the paddle member contacting the sheet becomes larger at the second moving rate of the moving members than at the first moving rate, and a contact pressure between the sheet and belt member is made larger at the second moving rate of the moving members than at the first moving rate. With this configuration, apparent overlap between the elastic member of the return paddle 51 and sheet becomes large, so that aligning property deterioration that may occur at sheet loading because of shortage of sheet conveying distance can be suppressed even if the sheet shows large waviness (wavy sheet).

(13) In the sheet processing apparatus of (12), the moving members include a moving arm member (roller arm 50) that moves the paddle member in the sheet thickness direction and a belt arm member (return belt arm 106) that moves the belt member in the sheet thickness direction. With this configuration, the return paddle 51 and return belt 61 can be moved independently of each other, and thus the moving rate can be independently set, so that aligning property deterioration that may occur at sheet loading because of shortage of sheet conveying distance can be suppressed even if the sheet shows large waviness (wavy sheet).

(14) A sheet processing apparatus B that applies processing to a loaded sheet includes a conveying roller 48 that conveys a sheet, a processing tray 58 on which the sheet from the conveying roller is loaded, a reference member (reference stopper 62) provided at one end of the processing tray, a transfer member (return paddle 51) having an elastic piece for switch-back conveying the sheet from the conveying roller to the reference member, a forward/backward rotatable sheet discharge roller (upper sheet discharge roller 52*a*) that discharges the sheet loaded on the processing tray and assists conveyance of the sheet when the transfer member conveys the sheet to the reference member, a moving member (roller arm 50) that moves the sheet discharge roller and the paddle member in the sheet thickness direction at a predetermined moving rate according to the number of sheets loaded on the processing tray, a determination section (sheet-type sensor 170/sheet processing control section (control CPU) 205) that determines the type of a sheet loaded on the processing tray, and a control section (conveyance control section 210) that controls movement of the moving member based on determination made by the determination section. The control section moves the moving member at a constant rate in the sheet thickness direction every time the number of loaded sheets is increased when the sheet type is determined to be a first type by the determination section and moves the moving member at a rate different from the moving rate for the first type sheet when the sheet type is determined to be a second type. With this configuration, the moving rate of the sheet discharge roller and the transfer member is changed depending on the type of a sheet loaded on the processing tray, so that even the wavy sheet can be properly conveyed, thereby suppressing sheet aligning property from being deteriorated at sheet loading.

(15) In the sheet processing apparatus of (14), the transfer member is a paddle member (return paddle 51) having an elastic piece. The moving rate of the moving member in the sheet thickness direction for the second type sheet is smaller after the number of sheets exceeds a predetermined value (30 sheets) before the number of sheets reaches the predetermined value (the moving ratio is reduced from 4 mm per five sheets to 2.5 mm per five sheets when the number of sheets reaches 30). With this configuration, the conveying force is increased when the number of sheets exceeds a predetermined number, so that aligning property of even the wavy sheet can be suppressed from being deteriorated at sheet loading.

(16) In the sheet processing apparatus of (15), the second type sheet is a sheet with larger waviness when being on the processing tray than the first type sheet. Thus, aligning property of even the wavy sheet can be suppressed from being deteriorated at sheet loading.

(17) In the sheet processing apparatus of (16), the determination section determines the type of a sheet loaded on the processing tray by moving the moving member to the loaded sheets after the number of sheets reaches a predetermined value (e.g., five sheets) sufficient for the sheet-type detection and moving a sheet-type sensor (sheet-type sensor 170) provided in the moving member. With this configuration, the sheet type can be determined during loading of the sheet onto the processing tray.

(18) In the sheet processing apparatus of (17), the sheet-type sensor includes a first sensor flag (first-type sensor flag 172) that contacts the sheet loaded on the processing tray to be moved and a second sensor flag (second-type sensor flag 176) that receives larger resistance when being moved than the first sensor flag. Thus, by making the moving resistances of the sensor flags different from each other, the sheet type can be determined.

(19) In the sheet processing apparatus of (16), the determination section (sheet processing control section (control CPU) 205) externally (from the image forming main body apparatus A1) acquires sheet type information indicating whether the sheet is the first type sheet or second type sheet having larger waviness than the first type sheet. With this configuration, the sheet type information is acquired from the image forming main body apparatus A1, and movement of the sheet discharge roller or paddle member can be controlled based on the sheet type information.

(20) An image forming apparatus A includes an image forming section (image forming section 3) that forms an image onto a sheet and the sheet processing apparatus described in any one of the above (1) to (19) that applies processing to the sheet onto which an image is formed by the image forming section. Thus, the image forming apparatus A provided with the sheet processing apparatus having the effects described in the above (1) to (19) can be provided.

In the description of the effects of the embodiment, specific member names (in parentheses) or reference numerals are given to constituent elements recited in the claims so as to clarify a correspondence relationship between the description of "Detailed Description" and the description of "What is Claimed is".

Further, it should be appreciated that the present invention is not limited to the above embodiment, and various modifications may be made thereto. Further, all the technical matters included in the technical ideas set forth in the claims should be covered by the present invention. While the invention has been described based on a preferred embodiment, various substitutions, corrections, modifications, or improvements may be made from the content disclosed in the specification by a person skilled in the art, which are included in the scope defined by the appended claims.

This application is based upon and claims the benefit of priority from prior Japanese Patent Applications No. 2017-038880, filed Mar. 2, 2017, No. 2017-038881, filed on the same date, and No. 2017-038882, filed on the same date, the entire contents of which are incorporated herein by reference.

What is claimed is:

1. A sheet processing apparatus that applies processing to a loaded sheet, comprising:

an entrance through which a sheet is received;

an entrance sensor that detects the sheet fed through the entrance;

a conveying roller that conveys the sheet;

a processing tray on which the sheet from the conveying roller is loaded;

a reference member provided at one end of the processing tray;

a transfer member that transfers the sheet from the conveying roller to the reference member;

a moving member that moves the transfer member; and a controller controlling the moving member to move the transfer member in a sheet thickness direction at a predetermined moving rate according to the number of sheets detected by the entrance sensor and loaded on the processing tray, wherein the controller reduces the moving rate of the moving member as the number of sheets detected by the entrance sensor and loaded on the processing tray is increased.

2. The sheet processing apparatus according to claim 1, wherein the transfer member is a paddle member having an elastic piece, and the controller sets the moving rate of the moving member to a first moving rate until the number of sheets loaded on the processing tray reaches a predetermined value and sets the moving rate of the moving member to a second moving rate lower than the first moving rate after the number of sheets exceeds the predetermined value.

3. The sheet processing apparatus according to claim 2, wherein the controller controls a degree of engagement between the paddle member and the sheet to be greater at the second moving rate of the moving member than at the first moving rate.

4. The sheet processing apparatus according to claim 2, wherein the controller controls an overlap amount between the paddle member and the sheet to be increased such that elastic deformation of the paddle member contacting the sheet becomes larger at the second moving rate of the moving member than at the first moving rate.

5. The sheet processing apparatus according to claim 4, wherein the paddle member is rotated in a direction that switch-back conveys the sheet conveyed from the conveying roller to the reference member.

6. A sheet processing apparatus that applies processing to a loaded sheet, comprising:

an entrance through which a sheet is received;

an entrance sensor that detects the sheet fed through the entrance;

a conveying roller that conveys the sheet;

a processing tray on which the sheet from the conveying roller is loaded;

a reference member provided at one end of the processing tray;

a transfer member that switch-back conveys the sheet from the conveying roller to the reference member;

a forward/backward rotatable sheet discharge roller that discharges the sheet loaded on the processing tray and assists conveyance of the sheet when the transfer member conveys the sheet to the reference member; and a controller controlling a moving member to move the sheet discharge roller and the transfer member in a sheet thickness direction at a predetermined moving rate according to the number of sheets detected by the entrance sensor and loaded on the processing tray, wherein the controller reduces the moving rate of the moving member as the number of sheets detected by the entrance sensor and loaded on the processing tray is increased.

7. The sheet processing apparatus according to claim 6, wherein the transfer member is a paddle member having an elastic piece, the moving member is a support arm configured to be moved while supporting the paddle and sheet discharge roller, and when the paddle member is rotated, the sheet discharge roller is also rotated in the same direction as the paddle member.

8. The sheet processing apparatus according to claim 7, wherein the controller sets the moving rate of the support arm to a first moving rate until the number of sheets loaded on the processing tray reaches a predetermined value and sets the moving rate of the support arm to a second moving rate lower than the first moving rate after the number of sheets exceeds the predetermined value.

9. The sheet processing apparatus according to claim 8, wherein the controller controls an overlap amount between the sheet and the paddle member when they contact each other to be larger at the second moving rate of the support member than at the first moving rate, and the controller controls a separation distance between the sheet discharge roller and the sheet to be smaller at the second moving rate of the support arm than at the first moving rate.

10. A sheet processing apparatus that applies processing to a loaded sheet, comprising:

an entrance through which a sheet is received;

an entrance sensor that detects the sheet fed through the entrance;

a sheet sensor that detects a rear end of the sheet;

a conveying roller that conveys the sheet;

a processing tray on which the sheet from the conveying roller is loaded;

a reference member provided at one end of the processing tray;

a transfer member that switch-back conveys the sheet from the conveying roller to the reference member;

a return conveying member that contacts the sheet conveyed by the transfer member to convey it to the reference member; and a controller controlling moving members to move the transfer member and the return conveying member, respectively, in a sheet thickness direction at a predetermined moving rate according to the number of sheets detected by the entrance sensor and the sheet sensor and loaded on the processing tray, wherein the controller reduces the moving rates of the moving members as the number of sheets detected by the entrance sensor and the sheet sensor and loaded on the processing tray is increased.

11. The sheet processing apparatus according to claim 10, wherein the transfer member is a paddle member having an elastic piece, the return conveying member is an endless belt member, and the moving rates of the moving members are set to a first moving rate until the number of sheets loaded on the processing tray reaches a predetermined value and set to a second moving rate lower than the first moving rate after the number of sheets exceeds the predetermined value.

12. The sheet processing apparatus according to claim 11, wherein an overlap amount between the paddle member and the sheet is increased such that elastic deformation of the paddle member contacting the sheet becomes larger at the second moving rate of the moving member than at the first moving rate, and a contact pressure between the sheet and the belt member is made larger at the second moving rate of the moving member than at the first moving rate.

13. The sheet processing apparatus according to claim 12, wherein the moving members include a moving arm member that moves the paddle member in the sheet thickness direction and a belt arm member that moves the belt member in the sheet thickness direction.

14. A sheet processing apparatus that applies processing to a loaded sheet, comprising:

a conveying roller that conveys a sheet;

a processing tray on which the sheet from the conveying roller is loaded;

a reference member provided at one end of the processing tray;

a transfer member that switch-back conveys the sheet from the conveying roller to the reference member;

a forward/backward rotatable sheet discharge roller that discharges the sheet loaded on the processing tray and assists conveyance of the sheet when the transfer member conveys the sheet to the reference member;

a moving member that moves the sheet discharge roller and transfer member in a sheet thickness direction at a predetermined moving rate according to the number of sheets loaded on the processing tray;

a determination section that determines the type of a sheet loaded on the processing tray; and a controller that controls movement of the moving member based on determination made by the determination section, wherein the controller moves the moving member at a constant rate in the sheet thickness direction every time the number of sheets loaded on the processing tray is increased when the sheet type is determined to be a first type by the determination section and moves the moving member at a rate different from the moving rate for the first type sheet when the sheet type is determined to be a second type.

15. The sheet processing apparatus according to claim 14, wherein the transfer member is a paddle member having an elastic piece, and the moving rate of the moving member in the sheet thickness direction for the second type sheet is smaller after the number of sheets exceeds a predetermined value before the number of sheets reaches the predetermined value.

16. The sheet processing apparatus according to claim 15, wherein the second type sheet is a sheet with larger waviness when being on the processing tray than the first type sheet.

17. The sheet processing apparatus according to claim 16, wherein the determination section determines the type of a sheet loaded on the processing tray by moving the moving member to the processing tray after the sheet is loaded on the processing tray in such a state that the sheet-type can be detected and using a sheet-type sensor provided in the moving member.

18. The sheet processing apparatus according to claim 17, wherein the sheet-type sensor includes a first sensor flag that contacts the sheet loaded on the processing tray to be moved and a second sensor flag that receives larger resistance when being moved than the first sensor flag.

19. The sheet processing apparatus according to claim 16, wherein the determination section externally acquires sheet type information indicating whether the sheet is the first type sheet or second type sheet having larger waviness than the first type sheet.

20. An image forming apparatus, comprising:

an image forming section that forms an image onto a sheet; and the sheet processing apparatus as claimed in claim 1 that applies processing to the sheet onto which an image is formed by the image forming section.

* * * * *